US009618873B2

(12) United States Patent
Murakami et al.

(10) Patent No.: US 9,618,873 B2
(45) Date of Patent: Apr. 11, 2017

(54) IMAGE FORMING APPARATUS

(71) Applicant: CANON KABUSHIKI KAISHA, Tokyo (JP)

(72) Inventors: Ryuta Murakami, Suntou-gun (JP); Noriyuki Komatsu, Numazu (JP); Osamu Anan, Susono (JP); Tetsuya Numata, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/730,532

(22) Filed: Jun. 4, 2015

(65) Prior Publication Data

US 2015/0362856 A1 Dec. 17, 2015

(30) Foreign Application Priority Data

Jun. 12, 2014 (JP) ..... 2014-121243

(51) Int. Cl.
*G03G 15/04* (2006.01)
*G03G 21/16* (2006.01)
*G03G 21/18* (2006.01)

(52) U.S. Cl.
CPC . *G03G 15/04036* (2013.01); *G03G 15/04045* (2013.01); *G03G 21/1623* (2013.01); *G03G 21/1666* (2013.01); *G03G 21/1671* (2013.01); *G03G 21/1633* (2013.01);
(Continued)

(58) Field of Classification Search
USPC ..... 399/110
See application file for complete search history.

(56) References Cited

U.S. PATENT DOCUMENTS 6,308,024 B1 * 10/2001 Nakayama ..... B41J 29/12 399/92
6,970,667 B2 11/2005 Watanabe et al.
7,519,311 B2 4/2009 Murakami et al.
(Continued)

FOREIGN PATENT DOCUMENTS

JP 2010-181766 A 8/2010

OTHER PUBLICATIONS

Noriyuki Komatsu et al., U.S. Appl. No. 14/732,882, filed Jun. 8, 2015.

*Primary Examiner* — Clayton E Laballe
*Assistant Examiner* — Linda B Smith
(74) *Attorney, Agent, or Firm* — Fitzpatrick, Cella, Harper & Scinto

(57) ABSTRACT

An image forming apparatus includes a main body, a moving member movable while supporting an image forming portion having an image bearing member, between a position inside the main body and a position outside the main body so that at least a part of the image forming portion is removably mountable on the moving member as a cartridge, and an exposure device configured to expose the image bearing member with light through an exposure opening provided in the moving member. In addition, a shielding member is provided in the moving member to shield the exposure opening, and a holding mechanism holds the shielding member in a shielding position for shielding the exposure opening while the moving member is moved and holds the shielding member in a non-shielding position for opening the exposure opening when the moving member is in the inside position.

18 Claims, 18 Drawing Sheets

(52) U.S. Cl.
CPC ..... *G03G 21/1832* (2013.01); *G03G 21/1853* (2013.01); *G03G 2221/1684* (2013.01)

(56) References Cited

U.S. PATENT DOCUMENTS

| | | | | |
|---|---|---|---|---|
| 8,768,211 | B2 | 7/2014 | Hayashi et al. | |
| 9,026,001 | B2 | 5/2015 | Numata et al. | |
| 2004/0126134 | A1* | 7/2004 | Harada | G03G 21/1832 399/114 |
| 2005/0243156 | A1* | 11/2005 | Matsutomo | G03G 15/04045 347/136 |
| 2009/0245850 | A1* | 10/2009 | Kawai | G03G 15/04054 399/98 |
| 2011/0091222 | A1* | 4/2011 | Kim | G03G 21/1633 399/9 |

* cited by examiner

IMAGE FORMING APPARATUS

BACKGROUND OF THE INVENTION

Field of the Invention

The present invention relates to an image forming apparatus. More particularly, the present invention relates to an image forming apparatus suited for use as a copying machine, a printer (such as LED printer and laser beam printer), a facsimile machine, a word processor, and the like that are configured to form images on recording media by using an electrophotographic image forming process.

Description of the Related Art

Hitherto, in an image forming apparatus using an electrophotographic image forming process, there has been known a process cartridge system in which photosensitive drums and developing units each housing a developing roller to act on the corresponding photosensitive drums and each containing developer (toner) to be used for image formation are integrated with each other. Further, there has also been known a developing cartridge system in which the cartridge has only the developing units independently of the drums. Those cartridge systems allow users themselves to perform maintenance of the apparatus without service engineers. Thus, those cartridge systems have been widely used in image forming apparatus.

Further, there has also been known a technology of arranging a moving member to which process cartridges and developing cartridges are mounted, and pulling out the moving member from an inside position of a main body of the image forming apparatus to an outside position so that an operation of replacing various types of cartridges can be performed. This technology allows users to easily replace cartridges containing the developer.

Further, there has been known an image forming apparatus having exposure openings formed in a moving member. Specifically, the exposure openings are formed so that laser beams emitted from an exposure device configured to form electrostatic latent images, which is arranged in a main body, are radiated on photosensitive drums as image bearing members (Japanese Patent Application Laid-Open No. 2010-181766).

In the above-mentioned related-art apparatus, however, there is a risk in that the toner (developer) adhering to the photosensitive drum or the developing roller is scattered inside and outside the apparatus through the exposure openings of the exposure device due to a shock caused by mounting and removing the moving member to and from the main body when various types of cartridges are replaced.

Therefore, the developer is required to be prevented from being scattered inside the main body when the moving member is moved.

SUMMARY OF THE INVENTION

According to a representative embodiment of the present application, there is disclosed an image forming apparatus, comprising:

a main body;

a moving member movable with respect to the main body in a state of supporting an image forming portion comprising an image bearing member, the moving member assuming an inside position located inside of the main body and an outside position located outside of the main body so that at least a part of the image forming portion is removably mountable on the moving member as a cartridge;

an exposure device configured to perform light exposure for forming an electrostatic latent image on the image bearing member through an exposure opening provided in the moving member;

a shielding member provided in the moving member and configured to shield the exposure opening; and a holding mechanism configured to hold the shielding member in a shielding position corresponding to the exposure opening while the moving member is moved between the inside position and the outside position, and to hold the shielding member in a non-shielding position in which the exposure opening is opened when the moving member is located in the inside position.

Further features of the present invention will become apparent from the following description of exemplary embodiments with reference to the attached drawings.

DESCRIPTION OF THE EMBODIMENTS

Now, exemplary embodiments of the present invention will be described in detail with reference to the attached drawings.

First Embodiment (Image Forming Apparatus)

Figure 1:
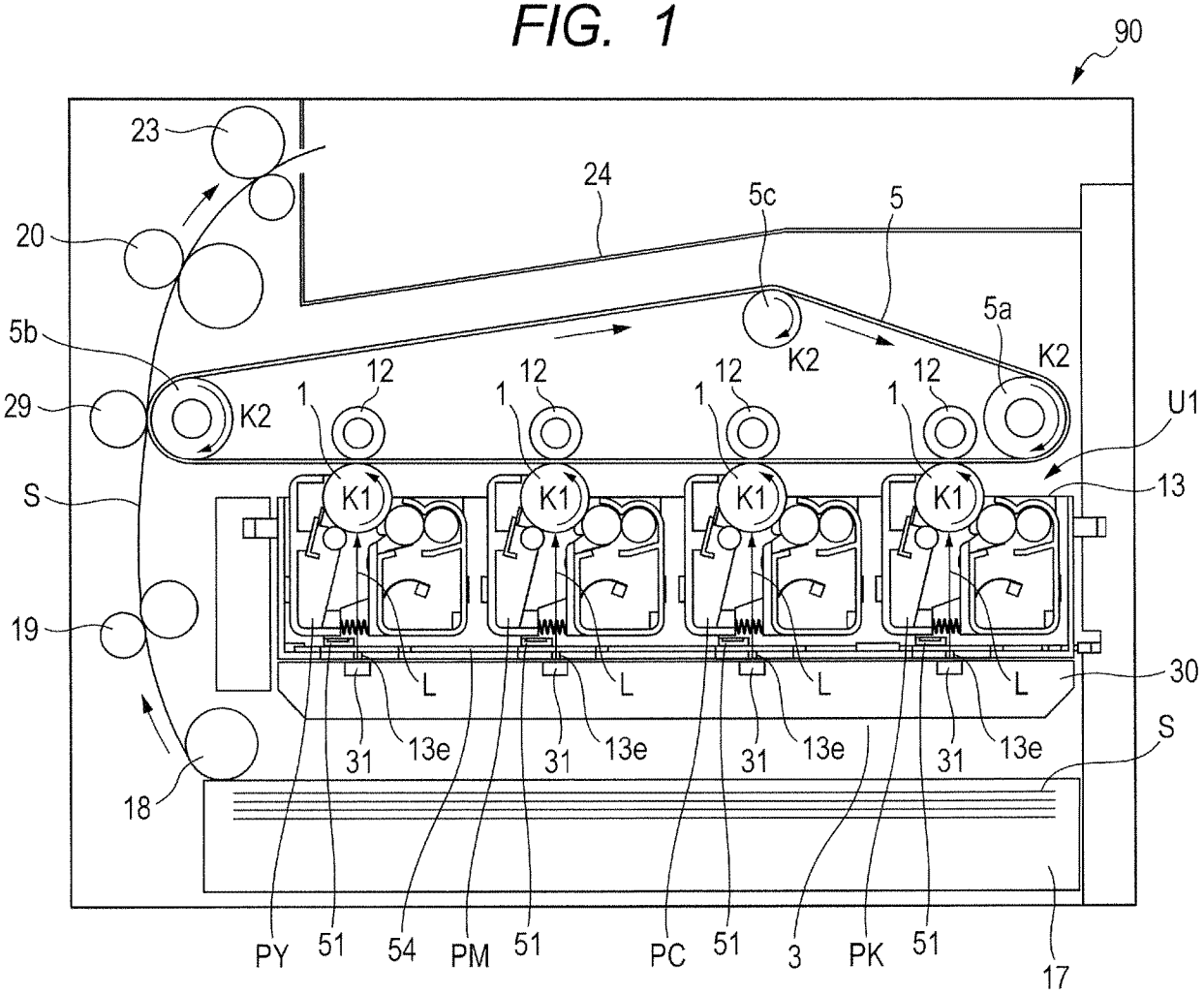
FIG. 1 is a sectional view of an image forming apparatus according to a first embodiment during image formation.
Figure 2:
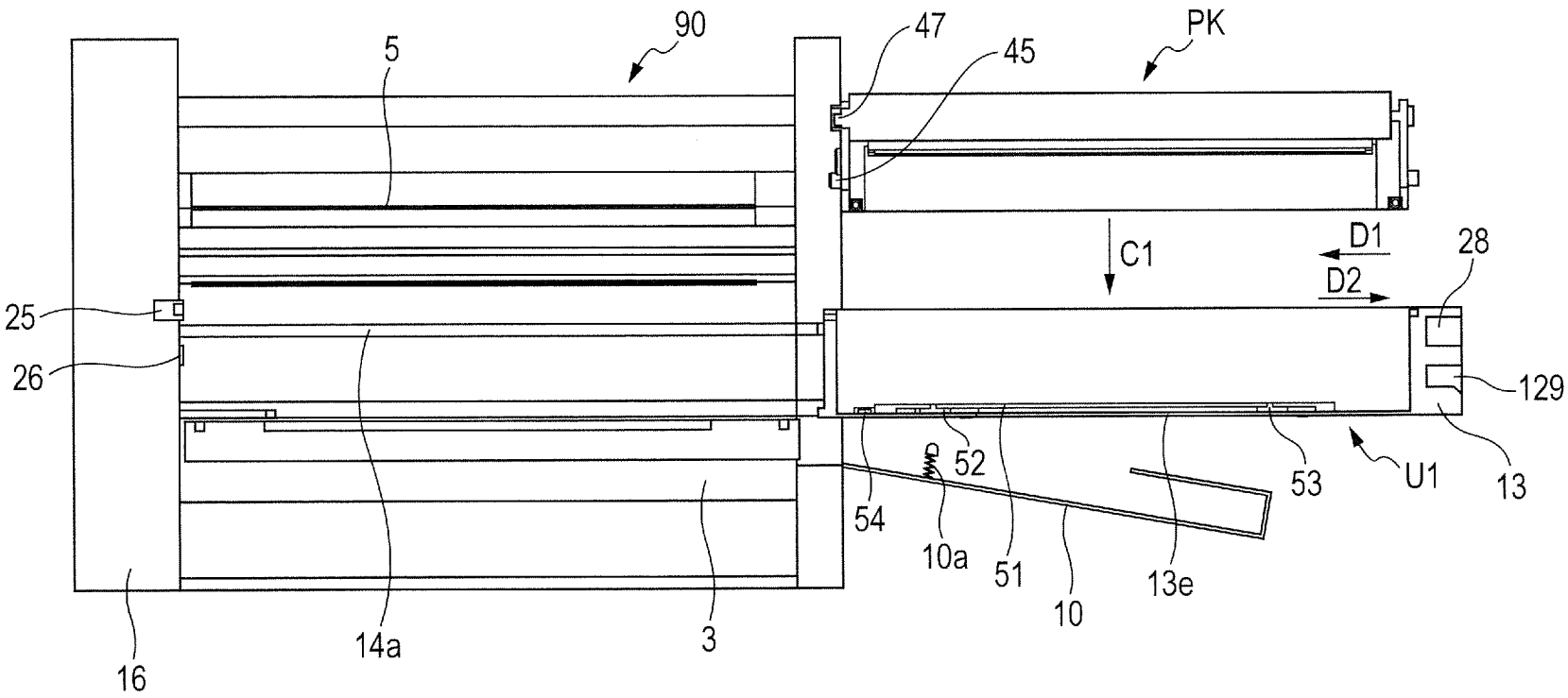
FIG. 2 is a sectional view for illustrating a state in which a pullout unit according to the first embodiment is pulled out of a main body of the image forming apparatus.
Figure 7:
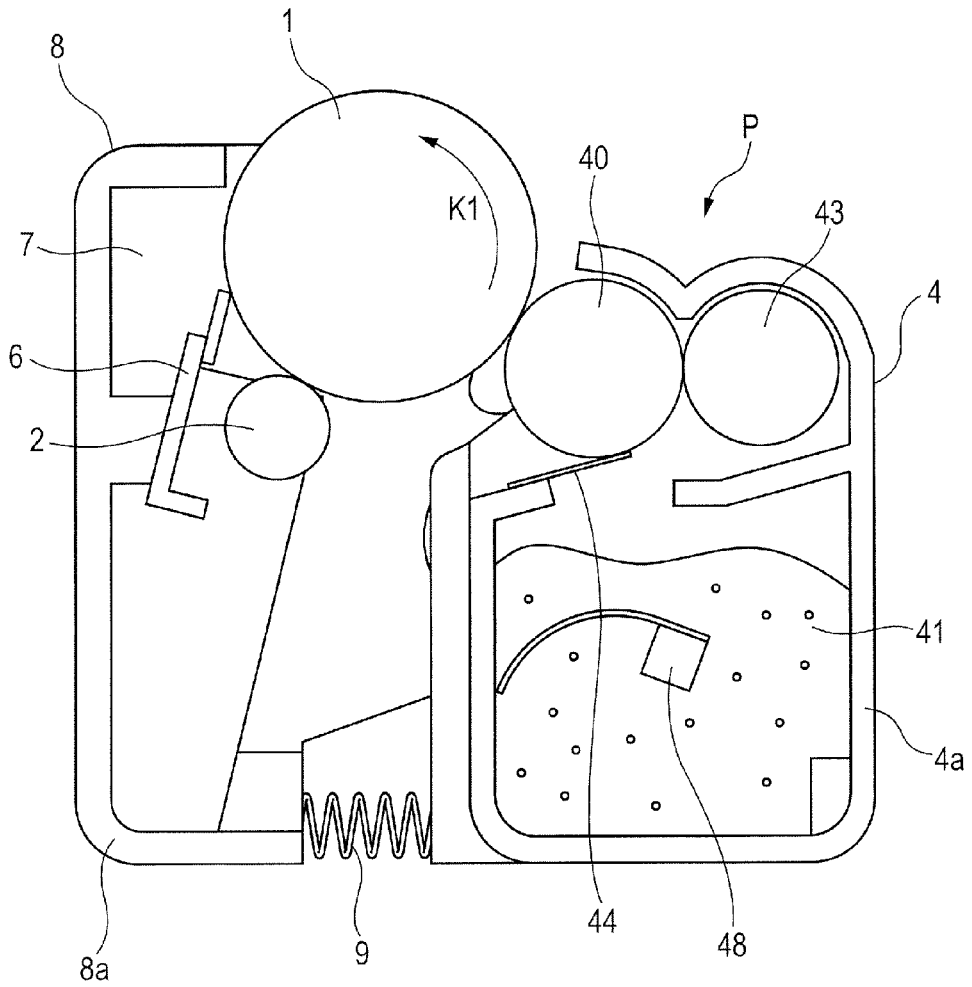
FIG. 7 is a sectional view of a cartridge according to the first embodiment.

Referring to FIGS. 1, 2, and 7, an overall structure of an image forming apparatus according to a first embodiment of the present invention will be described. FIG. 1 is a sectional view of an overall image forming apparatus according to the first embodiment. FIG. 2 is a sectional view of the image forming apparatus 90 according to the embodiment, for illustrating a state in which a pullout unit U1 is pulled out. FIG. 7 is a sectional view of a cartridge P according to the embodiment.

As illustrated in FIG. 1, the image forming apparatus 90 according to the embodiment includes image bearing member units (photosensitive member units) 8 including four electrophotographic photosensitive members as image bearing members (hereinafter referred to as "photosensitive drums 1" or "drums 1") that are arrayed in a horizontal direction. Those drums 1 are each rotated in a direction indicated by the arrow K1 in FIG. 1, which is a counterclockwise direction, by drive units (not shown).

Further, in the image forming apparatus 90, charging units 2, an exposure device 3, developing units 4, and an electrostatic transfer unit (a transfer member) 5 are provided as electrophotographic image forming process units in addition to the drums 1. Note that, the charging unit 2 has a function to uniformly charge a surface of the drum 1. The exposure device 3 includes, for example, an optical system (not shown), an optical box 30 configured to accommodate the optical system therein, and dust-proof members (light transmitting members) 31 having light transmitting properties. Exposure openings, through which laser beams L emitted from the optical system are radiated, are formed through the optical box 30. The dust-proof members 31 having light transmitting properties are mounted so as to be respectively in close contact with the exposure openings.

The developing unit 4 has a function to develop an electrostatic latent image formed on a surface of the drum 1 by using a toner as a developer. The electrostatic transfer unit 5 (hereinafter referred to as "intermediate transfer belt 5") has a function to transfer a toner image (developer image) formed on the drum 1 onto a sheet material S as a recording medium, which is a transferred material. Specific examples of the sheet material S include a paper sheet, an OHP sheet, and a cloth sheet.

Further, the image forming apparatus 90 includes cleaning units 6 (see FIG. 7) configured to remove toners remaining on the surfaces of the drums 1 after the transfer.

The drum 1 is obtained by, for example, applying an organic photoconductor layer (OPC photosensitive member) to an outer peripheral surface of an aluminum cylinder. Both end portions of the drum 1 are supported in a freely rotatable manner by a support member (not shown). Further, a first coupling member (a drum coupling) 47 (see FIG. 8) configured to receive a driving force from a drive motor (not shown) is arranged at one of the end portions. With this, the drum 1 receives the driving force transmitted from the drive motor through intermediation of the first coupling member 47, and is thereby rotated in the direction indicated by the arrow K1 in FIG. 1.

The charging unit 2 according to the embodiment employs a contact charging type. More specifically, the charging unit 2 is a conductive roller formed into a roller shape, and the charging roller 2 abuts against the surface of the drum 1. Then, a charging bias voltage is applied to the charging roller 2 so that the surface of the drum 1 is uniformly charged.

The developing units 4Y, 4M, 4C, and 4K (hereinafter referred to as "developing units 4") respectively include toner containers 41 (see FIG. 7) which respectively contain toners of yellow, magenta, cyan, and black (hereinafter represented by yellow: Y, magenta: M, cyan: C, and black: K). Note that, those toner containers serve as developer containing portions configured to contain developers (toners) to be supplied to developing rollers 40 as developer carrying members.

The toners in the toner containers 41 are supplied to toner supply rollers 43. Then, the toner supply roller 43 and a developing blade 44 which is held in press-contact with an outer periphery of the developing roller 40 causes the toner to be applied to the outer periphery of the developing roller 40 and to be electrically charged. Then, a developing bias is applied to the developing roller 40 so that the toner adheres to the latent image formed on the drum 1. With this, the toner image is formed. Note that, the developing roller 40 is arranged so as to face and come into contact with the drum 1.

The developing unit 4 and the drum 1 form each of cartridges PY, PM, PC, and PK (hereinafter referred to as "cartridges P") as process cartridges which are mountable and removable integrally. Each of the cartridges P may include only the developing unit 4. Specifically, at least a part of the image bearing member unit 8 and the developing unit 4, which form an image forming portion, is the cartridge P. When the toner is consumed through use by users and the cartridge P reaches its end of life, the cartridge P as a whole can be replaced (what is called a cartridge system).

A full-color image is formed by the following operation. The drums 1 of the cartridges P are each driven to rotate at a predetermined control speed in the direction indicated by the arrow K1 in FIG. 1, which is a counterclockwise direction. The charging rollers 2 are rotated in conjunction with the drums 1. Further, the intermediate transfer belt 5 is driven to rotate in a clockwise direction indicated by the arrow (forward direction of the rotation of the drum 1) at a speed in accordance with the speed of the drums 1. The intermediate transfer belt 5 is a flexible dielectric endless belt, and is stretched around a driving roller 5*a*, a secondary transfer opposing roller 5*b*, and a tension roller 5*c*.

Further, the developing roller 40 (see FIG. 7) and the toner supply roller 43 are each driven to rotate at a predetermined control speed. In synchronization with the driving, in each of the cartridges P, a predetermined charging bias is applied to the charging roller 2 at a predetermined control timing. With this, the surface of the drum 1 is uniformly charged with a predetermined polarity and electric potential by the charging roller 2.

The exposure device 3 exposes the surfaces of the drums 1 in the cartridges P with the laser beams L in accordance with image signals of Y, M, C, and K of the respective colors. With this, the electrostatic latent images of the image signals of corresponding colors are formed on the surfaces of the drums 1 of the cartridges P. Then, in each of the cartridges P, the electrostatic latent image formed on the surface of the drum 1 is developed into the developer image by the developing roller 40. In each of the cartridges P, a predetermined developing bias is applied at a predetermined control timing to the developing roller 40. Through the electrophotographic image forming process operation as described above, a Y-color developer image corresponding to a Y-color component of the full-color image is formed on the drum 1 of the cartridge PY.

Then, the developer image on the drum 1 is primarily transferred onto the intermediate transfer belt 5 at a primary-transfer nip portion as an abutment portion between the drum 1 and the intermediate transfer belt 5. A primary transfer roller 12 is held in press-contact with the drum 1 through intermediation of the intermediate transfer belt 5. With this, the primary-transfer nip portion is formed. In a similar manner, an M-color developer image formed on the corresponding drum 1 in the cartridge PM, a C-color developer image formed on the corresponding drum 1 in the cartridge PC, and a K-color developer image formed on the corresponding drum 1 in the cartridge PK are primarily transferred onto the intermediate transfer belt 5 through intermediation of the corresponding drums 1.

In this way, on the intermediate transfer belt 5, a four-full-color unfixed developer image is formed by combining the color Y, the color M, the color C, and the color K. Note that, the developer images of those colors need not necessarily be superimposed and transferred sequentially onto the intermediate transfer belt 5 in the order described above. In each of the cartridges P, an untransferred residual developer remaining on the drum surface after the primary transfer of the developer image onto the intermediate transfer belt 5 is removed by a blade (cleaning unit) 6, and collected into a waste toner container 7 (see FIG. 7).

Meanwhile, a feed roller 18 is driven at predetermined control timings. With this, the sheet-shaped recording media S (transferred materials) contained and stacked in a sheet feeding cassette 17 are fed. Then, at a predetermined control timing, the recording medium S is introduced by a registration roller pair 19 into a secondary-transfer nip portion as an abutment portion between the intermediate transfer belt 5 and a secondary transfer roller 29.

A secondary transfer bias having a polarity reverse to the charging polarity of the developer and having a predetermined electric potential is applied to the secondary transfer roller 29 at a predetermined control timing. With this, the four-color-superimposed developer image on the intermediate transfer belt 5 is secondarily transferred onto a surface of the recording medium S while the recording medium S is nipped and conveyed through the secondary-transfer nip portion.

The recording medium S, which passes through the secondary-transfer nip portion, is separated from the surface of the intermediate transfer belt 5 and is introduced into a fixing device 20. Then, the recording medium S is heated and pressurized in a fixing nip portion. With this, the above-mentioned colors of the developer images are mixed with each other, and the developer images are fixed onto the recording medium S. Then, the recording medium S is fed out of the fixing device 20, and delivered as a full-color image product by a delivery roller pair 23 onto a delivery tray 24.

In the configuration of the embodiment, the intermediate transfer belt 5 is arranged above the drums 1 in a vertical direction (in a gravity direction), and the exposure device 3 is arranged below the drums 1 in the vertical direction. Thus, immediately after the formation of the unfixed developer image of the color Y, the color M, the color C, and the color K on the intermediate transfer belt 5, the unfixed developer image can be transferred onto the recording medium S through intermediation of the secondary transfer roller 29. In this way, there is provided an advantage that a first printed material can be quickly output.

(Moving Member)

In the embodiment, the "main body" means various members (components) constructing the image forming apparatus 90 excluding at least a moving member 13 and members (components) fixed to the moving member 13 or configured to be mountable into and removable from the moving member 13.

The moving member 13 will be described. The moving member 13 supports the drums 1 and is movable between an inner position (inside position) and an outer position (outside position). The inside position is located inside of the main body, whereas the outside position is located outside of the main body. As illustrated in FIG. 2, the moving member 13 can be linearly moved with respect to (pushed into or pulled out of) the main body substantially in the horizontal direction (directions indicated by the arrows D1 and D2). Further, the moving member 13 can be moved to the inner position located inside of the main body (position illustrated in FIG. 1), or to the outer position at which the moving member is pulled out of the main body (position illustrated in FIG. 2).

In a state in which the moving member 13 is located in the outer position, the cartridges P (PY, PM, PC, and PK) are mounted on the moving member 13 substantially in the gravity direction (direction indicated by the arrow C1 in FIG. 2) by a user. A moving direction of the moving member 13 is parallel to a longitudinal direction of the cartridges P (axial direction of the drums 1). Further, the four cartridges PY, PM, PC, and PK are arrayed in a direction orthogonal to the moving direction of the moving member 13.

The cartridges P are moved to the inside and outside of the main body together with the moving member 13 in a state in which the cartridges P are mounted in (supported by) the moving member 13. When a door 10 is closed in a state after the moving member 13 is moved into the main body, all the cartridges P are positioned at predetermined positions inside the main body.

In this way, in the image forming apparatus 90 according to the embodiment, the four cartridges P can be collectively mounted on the main body, and the four cartridges P can be collectively pulled out of the main body. Thus, operability at the time of replacement of the cartridges P is more excellent than that in a case where a configuration of independently mounting the cartridges into the main body is employed.

Note that, the moving member 13 having the cartridges P mounted thereon is hereinafter referred to as a pullout unit U1.

(Mounting Portion of Main Body for Moving Member)

Figure 3:
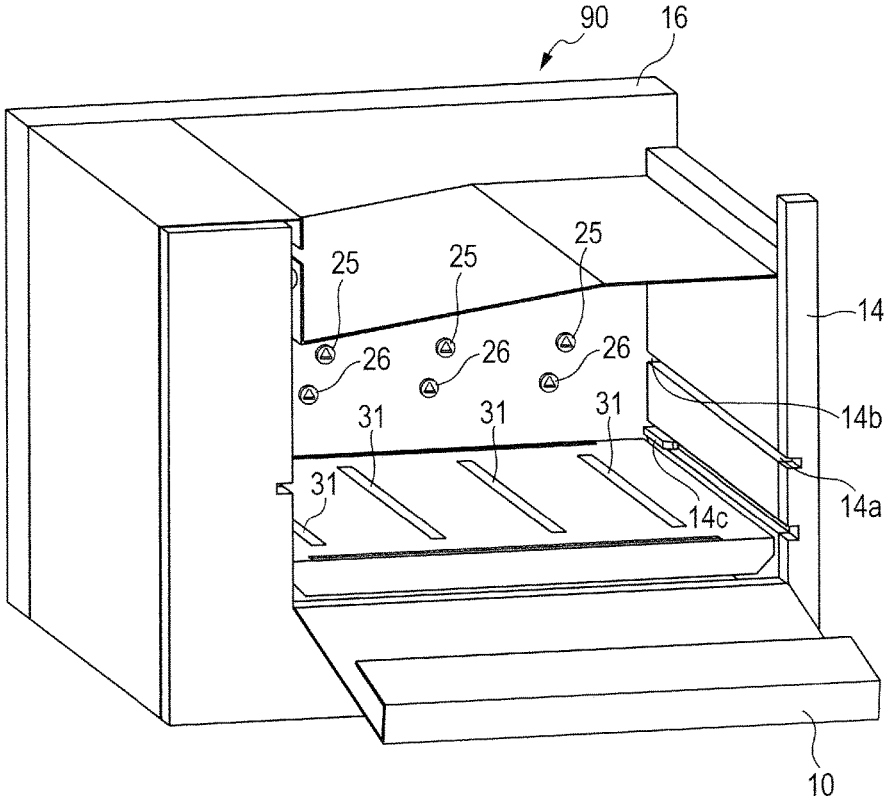
FIG. 3 is a perspective view for illustrating a mounting portion of the main body of the image forming apparatus for a moving member according to the first embodiment.
Figure 4:
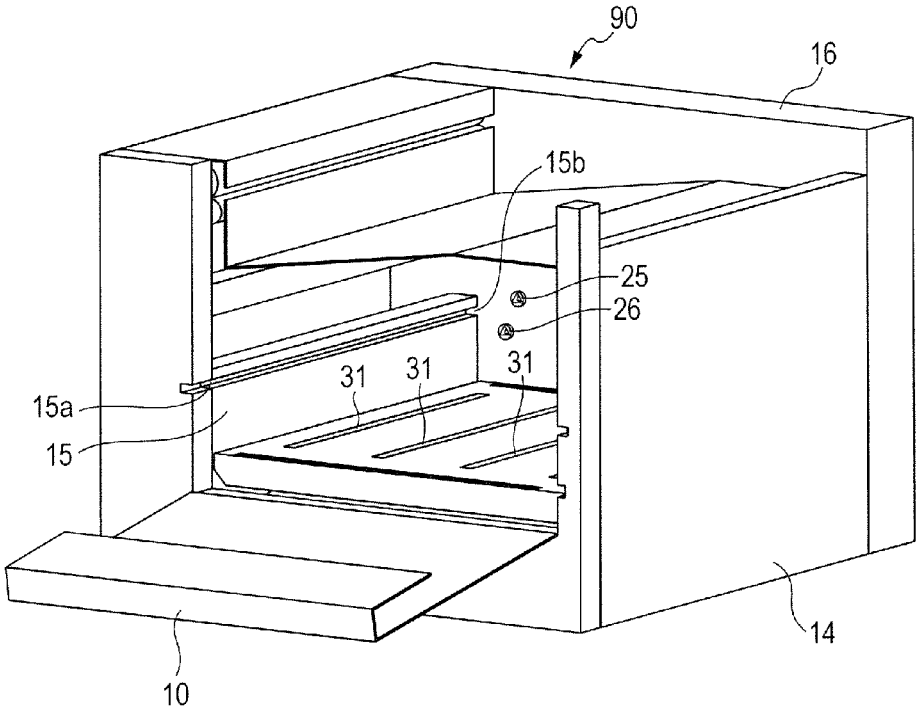
FIG. 4 is another perspective view for illustrating the mounting portion of the main body of the image forming apparatus for the moving member according to the first embodiment.

Next, referring to FIGS. 3 and 4, a configuration of a mounting portion of the main body for the moving member 13 will be described. FIGS. 3 and 4 are each a perspective view for illustrating the mounting portion of the main body of the image forming apparatus 90 for the moving member 13 according to the embodiment. Note that, in FIGS. 3 and 4, for ease of understanding of the configuration of the mounting portion, of the members (components) of the main body, the intermediate transfer belt 5 and other members are not illustrated. Further, the perspective views of FIGS. 3 and 4 are different in viewing direction from each other.

A guiding portion 14*a* is provided on an inner wall surface of a main-body side frame 14, whereas a guiding portion 15*a* is provided on an inner wall surface of a main-body side frame 15. The guiding portions 14*a* and 15*a* are provided in pairs so as to be opposed to each other. The pair of guiding portions 14*a* and 15*a* guides the moving member 13 in the moving direction. The guiding portions 14*a* and 15*a* are portions which guide guided portions 13*a*, 13*b*, 13*c*, and 13*d* (see FIGS. 5 and 6) of the moving member 13, which will be described later. Each of the guiding portions 14*a* and 15*a* has a U-like cross section. The guiding portions 14*a* and 15*a* are formed to extend from the vicinity of an inlet of the main body (vicinity of the door 10) to a far side of the main body substantially in the horizontal direction so that the moving member 13 can be guided from a position at which the moving member 13 is pulled out of the main body to a position at which the moving member 13 is received inside the main body.

Further, as illustrated in FIG. 3, drum coupling members 25 and development coupling members 26 are provided on a main-body back frame 16 at equal intervals in the horizontal direction. The drum coupling members 25 transfer drive to the drums 1, whereas the development coupling members 26 transmit drive to the developing rollers 40. The drum coupling members 25 and the development coupling members 26 transmit a driving force from a drive source (not shown) to the cartridges P. In a state in which the door 10 is opened, the drum coupling members 25 and the development coupling members 26 are in a retracted state inside side walls. In conjunction with an operation of closing the door 10, the drum coupling members 25 and the development coupling members 26 are configured to move toward the cartridges P.

(Moving Member)

Figure 5:
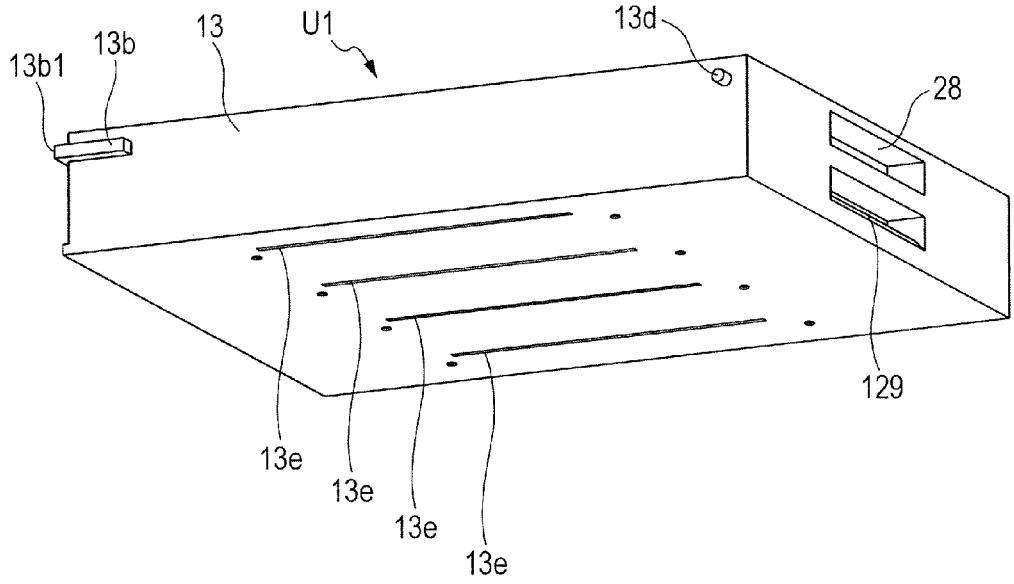
FIG. 5 is a perspective view of the pullout unit according to the first embodiment.
Figure 6:
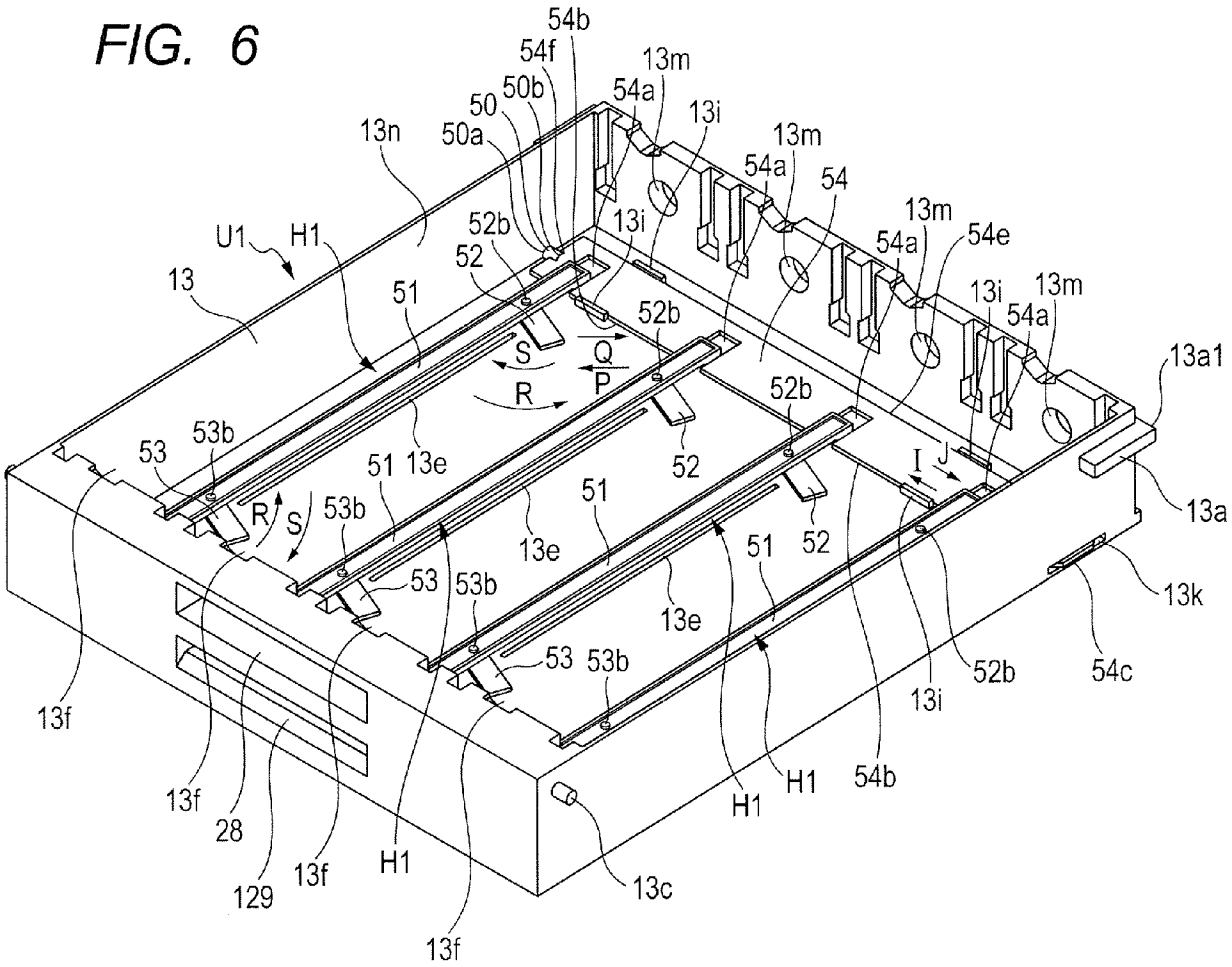
FIG. 6 is another perspective view of the pullout unit according to the first embodiment.

Next, the moving member 13 will be described in detail referring to FIGS. 5 and 6. FIG. 5 is a perspective view of the pullout unit U1 in the image forming apparatus 90 according to the embodiment. FIG. 6 is a perspective view of the pullout unit U1 as viewed from a side opposite to that in FIG. 5.

The guided portion 13*a*, 13*b*, 13*c*, and 13*d*, which are guided by the guiding portions 14*a* and 15*a* of the main body, are provided at four corners of the moving member 13. The guided portions 13*a* and 13*c* are guided by the guiding portion 14*a*, whereas the guided portions 13*b* and 13*d* are guided by the guiding portion 15*a*. Each of the guided portions 13*a* and 13*b* has a shape projecting outward from a corresponding side surface, and is formed to extend in a pullout direction so as to prevent the moving member 13 from being inclined when the moving member 13 is located in a pull-out position (an outside position). Each of the guided portions 13*c* and 13*d* has a columnar shape, and is formed to project outward from a corresponding side surface.

A grip portion 28 configured to allow the user to operate the pullout unit U1 is provided on one end of the moving member 13. A concave portion 129 is provided below the grip portion 28 so that a pressing member 10*a* (see FIG. 2) provided on the door 10 comes into abutment against the concave portion 129. The pressing member 10*a* abuts against the concave portion 129 to bias the pullout unit U1, thereby positioning the pullout unit U1 inside the main body. The details thereof will be described later.

Further, mounting portions 13*f* (FIG. 6) configured to mount the cartridges P described later therein are formed in a row in the moving member 13. Exposure openings 13*e* (FIGS. 5 and 6), through which the light beams radiated from the exposure device 3 toward the drums 1 pass, are formed through a bottom surface of the moving member 13 below the mounting portions 13*f*. Protection member units H1, each including a projection member as a shielding member configured to shield a corresponding exposure opening 13*e*, are arranged. The details thereof will be described later.

As illustrated in FIG. 6, opening portions 13*m*, into which the development coupling members 26 described above are to be moved, are formed in the moving member 13. The development coupling members 26 are moved into the opening portions 13*m* in conjunction with an operation of closing the door 10.

As described above, the pullout unit U1 includes the moving member 13 and the protection member units H1.

(Cartridge)

Figure 8:
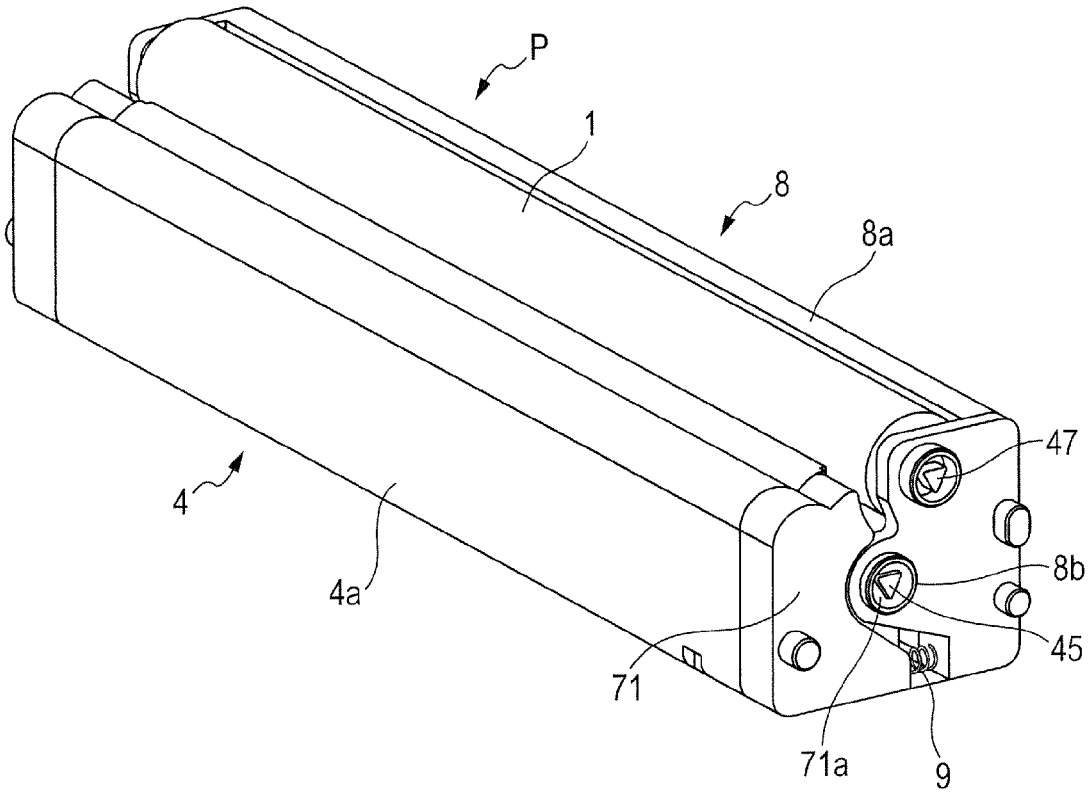
FIG. 8 is a perspective view of the cartridge according to the first embodiment as viewed from a driving side.
Figure 9:
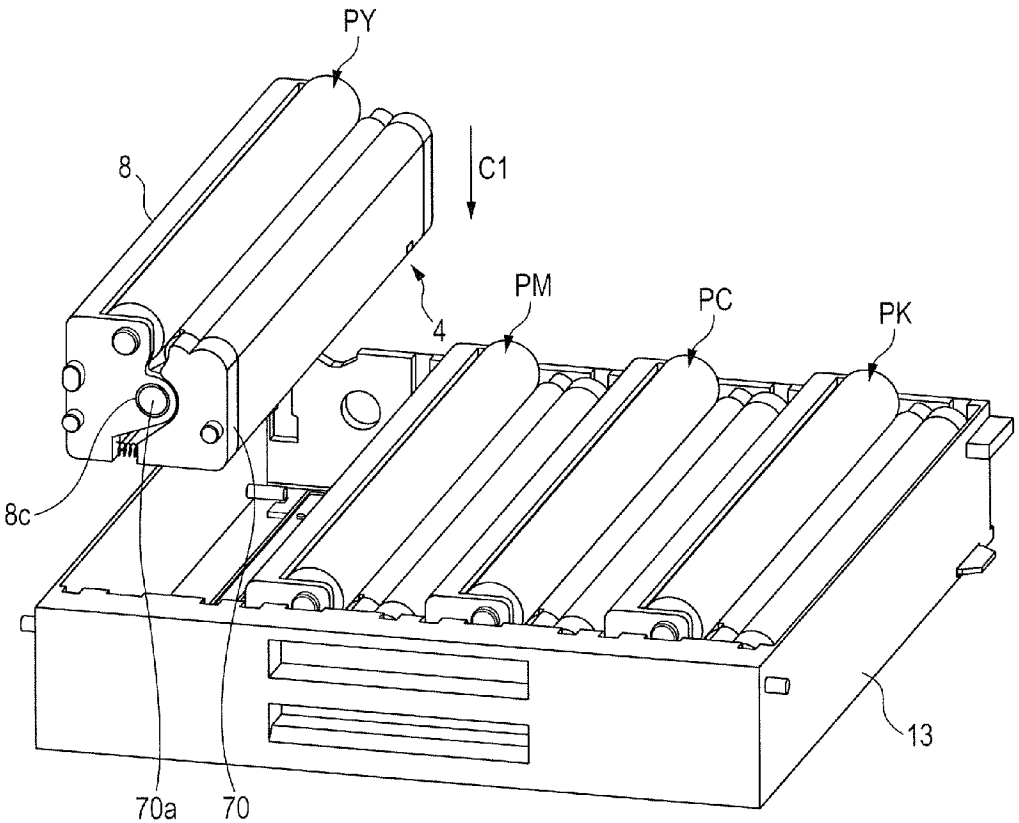
FIG. 9 is a perspective view for illustrating a state in which the cartridge according to the first embodiment is being mounted on the pullout unit as viewed from a non-driving side.

Next, referring to FIGS. 7 to 9, the cartridge P to be mounted on the moving member 13 will be described. FIG. 7 is a sectional view of the cartridge P according to the embodiment, FIG. 8 is a perspective view of the cartridge P according to the embodiment, and FIG. 9 is a perspective view for illustrating a state in which the cartridge P according to the embodiment is being mounted on the moving member 13.

The cartridge P includes the photosensitive member unit 8 including the photosensitive drum 1 as the image bearing member, and the developing unit 4 including the developing roller 40 as the developer carrying member. Further, the photosensitive member unit 8 includes the drum 1, a photosensitive member frame 8*a* configured to support the drum 1, the charging unit 2, the cleaning unit 6, and the waste toner container 7 configured to collect the toner removed by the cleaning unit 6. Further, the developing unit 4 includes the developing roller 40, a developing frame 4*a* configured to support the developing roller 40, the toner supply roller 43, the developing blade 44, the toner container 41 configured to contain the toner to be used for image formation, and a conveying member 48 configured to supply the toner in the toner container 41.

As described above, the toner in the toner container 41 is supplied to the toner supply roller 43 by the conveying member 48. Then, the toner supply roller 43 and the developing blade 44 which is held in press-contact with the outer periphery of the developing roller 40 cause the toner to be applied to the outer periphery of the developing roller 40 and to be electrically charged. Then, a developing bias is applied from the main body to the developing roller 40 so that the toner adheres to the latent image formed on the drum 1. With this, the toner image is formed.

After the toner image borne on the drum 1 is transferred onto the intermediate transfer belt 5 (see FIG. 1), the toner remaining on the surface of the drum 1 is removed by the cleaning unit 6, and collected into the waste toner container 7.

Note that, in a case where the toner in the toner container 41 is consumed, the user only has to replace the cartridge P to perform printing again.

As illustrated in FIG. 8, at one end portion of the cartridge P, the first coupling member 47 configured to receive the driving force through intermediation of the drum coupling member 25 on the main body side is supported to be rotatable. In addition, a second coupling member 45 configured to receive the driving force through intermediation of the development coupling member 26 is also supported to be rotatable. The first coupling member 47 is arranged at the one end of the drum 1 to receive the driving force from the main body for rotating the drum 1. Further, the driving force received by the second coupling member 45 is transmitted to the developing roller 40, the toner supply roller 43, and the conveying member 48 through intermediation of an intermediate gear (not shown) to rotate those components.

An outer periphery of the second coupling member is covered with a cylindrical rib. With this, an engagement portion 71*a* is formed on a side cover 71 fixed to an outside of the toner container 41. The second coupling member 45 is configured to be rotatable about the engagement portion 71*a*. Further, as illustrated in FIG. 9, an engagement portion 70*a* is formed also on a side opposite to the engagement portion 71*a* in a longitudinal direction. The engagement portion 70*a* is similarly formed on a side cover 70. The engagement portions 71*a* and 70*a* are formed in the developing unit 4.

Further, hole portions 8*b* and 8*c* configured to support the engagement portions 71*a* and 70*a* are provided in the photosensitive member frame 8*a*. The hole portions 8*b* and 8*c* provided in the photosensitive member frame 8*a* are engaged with the engagement portions 71*a* and 70*a* provided on the developing unit 4. With this, the photosensitive member unit 8 and the developing unit 4 are coupled to each other. Specifically, the engagement portions 71*a* and 70*a* are configured to be movable (rotatable) respectively about the hole portions 8*b* and 8*c*, and hence the developing unit 4 can be moved with respect to the photosensitive member unit 8. In other words, the developing roller 40 is configured to be movable with respect to the drum 1.

As illustrated in FIGS. 7 and 8, a spring 9 as a biasing member is interposed between the photosensitive member unit 8 and the developing unit 4. The spring 9 generates a predetermined pressure for pressing the developing roller 40 against the drum 1.

(Mounting of Cartridge on Moving Member)

Referring to FIG. 9, how the cartridges P (PY, PM, PC, and PK) are mounted on the moving member 13 will be described. FIG. 9 is a perspective view for illustrating the state in which the cartridges P according to the embodiment are being mounted on the moving member 13. The cartridges PY, PM, PC, and PK are mounted respectively on the mounting portions 13*f* provided at four positions in the moving member 13 (see FIG. 6). The user mounts the cartridges P in a direction indicated by the arrow C1 substantially corresponding to the gravity direction (vertical direction).

(Mounting of Pullout Unit into Main Body)

An operation of mounting the pullout unit U1 into the main body will be described referring to FIG. 2. As illustrated in FIG. 2, the pullout unit U1 is mounted in a direction indicated by the arrow D1 so that the guided portions 13*a*, 13*b*, 13*c*, and 13*d* (see FIGS. 5 and 6) of the moving member 13 move along the guiding portions 14*a* and 15*a* (see FIGS. 3 and 4) provided on the main body. The intermediate transfer belt 5 is configured to retract from the image forming position through an operation of opening the door 10. Therefore, while the pullout unit U1 is being operated, the surfaces of the drums 1 and a surface of the intermediate transfer belt 5 do not slide against each other.

FIG. 1 is an illustration of a state in which the door 10 is closed. Through the operation of closing the door 10, the drum coupling members 25 and the development coupling members 26 (see FIG. 3) move inward. Further, the intermediate transfer belt 5 moves down in conjunction with the door 10. Further, the pressing member 10*a*, which is provided integrally with the door 10, moves into the concave portion 129 formed in the moving member 13 to press the pullout unit U1 in the direction indicated by the arrow D1 (see FIG. 2).

As a result, a distal end portion 13*a*1 of the guided portion 13*a* and a distal end portion 13*b*1 of the guided portion 13*b* of the moving member 13 abut against a rear end portion 14*b* of the guiding portion 14*a* and a rear end portion 15*b* of the guiding portion 15*a*, respectively. Through the operations described above, the pullout unit U1 is positioned inside the main body, and the cartridges P received in the pullout unit U1 are also positioned inside the main body.

(Protection Members as Shielding Members)

Figure 10:
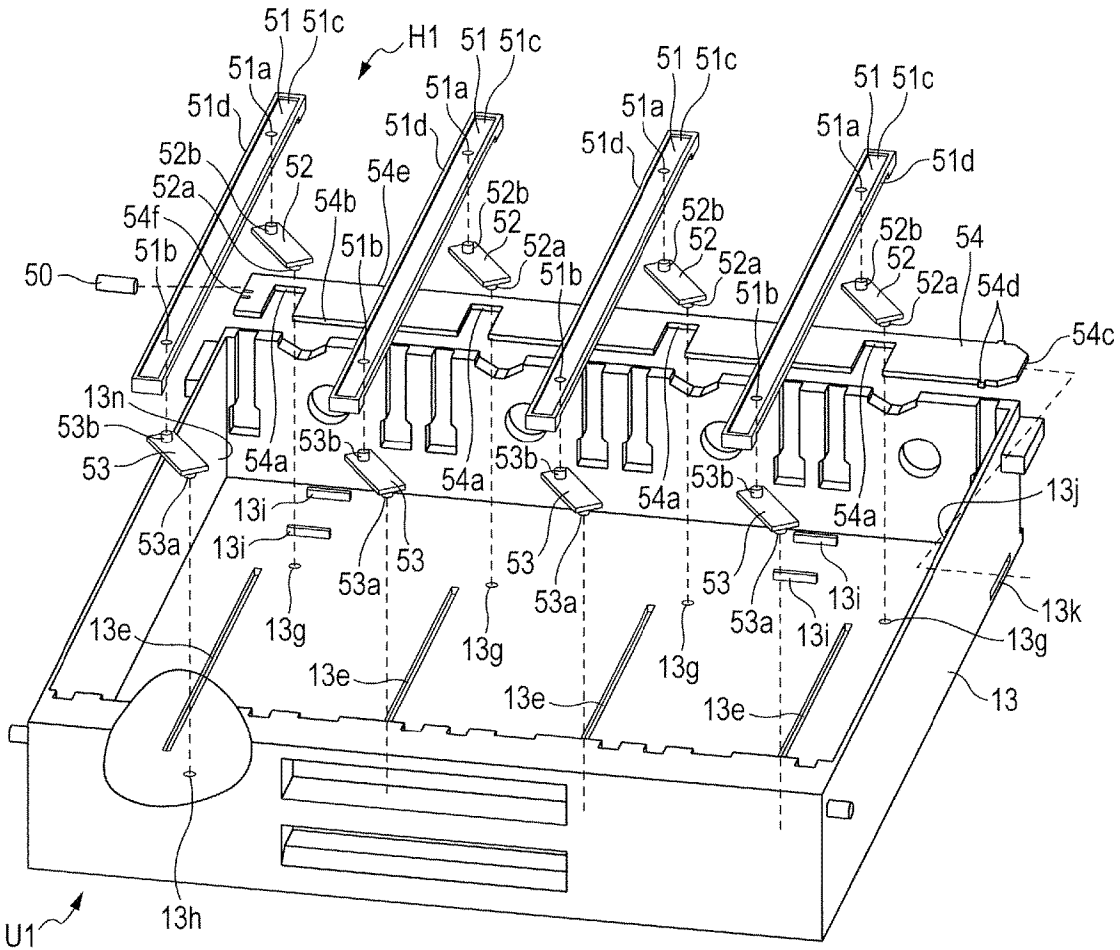
FIG. 10 is a perspective view for illustrating a configuration of the pullout unit according to the first embodiment.
Figure 11A:
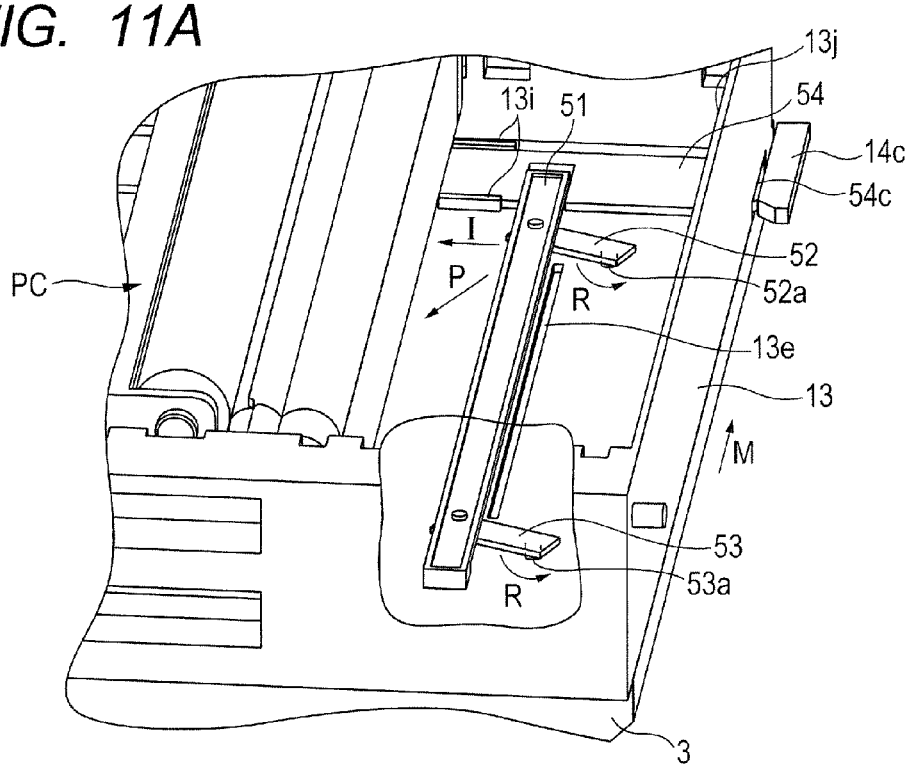
FIGS. 11A and 11B are perspective views for illustrating an operation of a protection member as a shielding member according to the first embodiment.
Figure 11B:
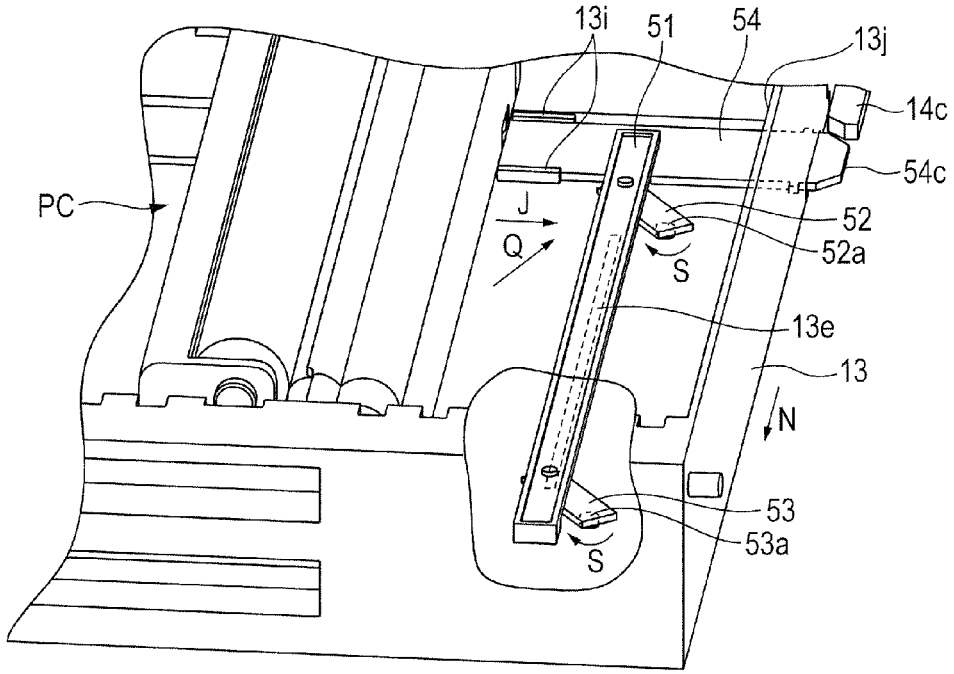

The protection member units H1 will be described referring to FIGS. 1, 2, 6, 10, 11A, and 11B. FIG. 10 is a perspective view for illustrating a configuration of the pullout unit U1, and FIGS. 11A and 11B are perspective views for illustrating an operation of the pullout unit U1. As illustrated in FIG. 6, the protection member units H1 are provided vertically above the dust-proof members 31 having light transmitting properties, which are held in close contact with the exposure openings 13*e*. The protection member unit H1 includes a protection member 51 as a shielding member capable of shielding the corresponding exposure opening 13*e*, link members 52 and 53, an actuating member 54, and a compression spring 50.

The link members 52 and 53, the actuating member 54, and the compression spring 50 function as a holding mechanism. The holding mechanism holds the protection member 51 as the shielding member in a shielding position corresponding to the exposure opening 13*e* during the movement of the moving member 13, and holds the protection member 51 in a non-shielding position shifted from the exposure opening 13*e* during the image formation. As illustrated in FIG. 10, each of the protection members 51 has a size large enough to cover the exposure opening 13*e*. Wall portions 51*d* are formed on four sides of each of the protection members 51.

A boss 52*a* is provided on one end of each of the link members 52, whereas a boss 52*b* is provided on another end of each of the link members 52. Similarly, a boss 53*a* is provided on one end of each of the link members 53, whereas a boss 53*b* is provided on another end of each of the link members 53. The boss 52*a* provided on the one end of the link member 52 is turnably fitted into a hole 13*g* formed in the vicinity of one end of the corresponding exposure opening 13*e* of the moving member 13, whereas the boss 53*a* provided on the one end of the link member 53 is turnably fitted into a hole 13*h* formed in the vicinity of another end of the corresponding exposure opening 13*e*. The boss 52*b* provided on the another end of the link member 52 is turnably fitted into a hole 51*a* provided on one end of the corresponding protection member 51, whereas the boss 53*b* provided on the another end of the link member 53 is turnably fitted into a hole 51*b* provided on another end of the corresponding protection member 51. In this manner, a four-bar parallel linkage is configured (formed), as illustrated in FIG. 6.

The actuating member 54 includes concave portions 54*a* formed at positions corresponding to the protection members 51 for the respective cartridges P. The actuating member 54 is slidably fitted over one end 51*c* of each of the protection members 51. The actuating member 54 also includes guiding portions 13*i* so as to be fitted to guided portions 54*b* and 54*e* of the actuating member 54. The actuating member 54 is movable in directions indicated by the arrows I and J (FIG. 6).

Further, as illustrated in FIG. 10, regulated portions 54*d* are provided on one end of the actuating member 54 in the directions indicated by the arrows I and J. The regulated portions 54*d* abut against regulating portions 13*j* as inner walls of the moving member 13 so as to regulate movement in the direction indicated by the arrow J. Further, a latched portion 54*c* as the one end of the actuating member 54 in the directions indicated by the arrows I and J projects beyond a hole 13*k* formed in the moving member 13. The latched portion 54*c* of the actuating member 54 abuts against a latching portion 14*c* (see FIG. 3) as a convex portion provided on the main body to regulate the movement in the direction indicated by the arrow J.

As illustrated in FIG. 6, one end 50*a* of the compression spring 50 abuts against an abutment portion 13*n* as an inner wall of the moving member 13, and another end 50*b* of the compression spring 50 abuts against a spring seat 54*f* provided on another end of the actuating member 54 to bias the actuating member 54 in the direction indicated by the arrow J.

(Operation of Protection Members as Shielding Members)

Next, an operation of the protection member unit H1 will be described referring to FIGS. 11A and 11B. FIG. 11A is a perspective view for illustrating a state during the image formation in which the moving member 13 assumes the inner position (inside position) of the main body, and FIG. 11B is an illustration of a state in which the door 10 of the main body is opened and the moving member 13 starts being pulled toward the near side. For easy understanding, the cartridge PK is omitted and the moving member 13 is partially cut out in both FIGS. 11A and 11B. In the main body, only the latching portion 14*c* is illustrated.

First, as illustrated in FIG. 11A, during the image formation, the latched portion 54*c* of the actuating member 54 is held in abutment against the latching portion 14*c* of the main body. The actuating member 54 is guided by the guiding portion 13*i* to move in the direction indicated by the arrow I. As a result, the protection members 51 also move in the direction indicated by the arrow I, and hence the link members 52 and 53 respectively rotate about the bosses 52*a* and 53*a* (see FIG. 10) in a direction indicated by the arrow R in FIG. 11A, which is a counterclockwise direction. As a result, the protection members 51 as the shielding members are moved in a direction indicated by the arrow P oriented to the lower left in FIG. 11A. Then, the exposure openings 13*e*, which have been covered with the protection members 51, are opened so that the laser beams L can pass through the exposure openings 13*e* (see FIG. 1).

On the other hand, when the moving member 13 is pulled out of the main body as illustrated in FIG. 11B, the actuating member 54 is biased by the compression spring 50 in the direction indicated by the arrow J. Then, the actuating member 54 is guided by the guiding portion 13*i* to be moved until the regulated portions 54*d* (see FIG. 10) abut against the regulating portions 13*j*. In this manner, the protection members 51 are also moved in the direction indicated by the arrow J, and hence the link members 52 and 53 rotate about the bosses 52*a* and 53*a* (see FIG. 10) in a direction indicated by the arrow S in FIG. 11B, which is a clockwise direction. As a result, the protection members as the shielding members are moved to the shielding positions in a direction indicated by the arrow Q oriented to the upper right in FIG. 11B so that the exposure openings 13*e* are covered with (shielded by) the protection members 51.

As described above, the image forming apparatus 90 according to the embodiment includes the pullout unit U1 including the protection members 51. The protection members 51 are arranged as the shielding members configured to open and close the exposure openings 13*e* formed in the pullout unit U1 in accordance with the operation of mounting or the operation of pulling out the pullout unit U1. According to the configuration described above, with the protection members 51 arranged as the shielding members for the exposure openings 13*e*, the toner can be prevented from dropping on a floor from the cartridges P through the exposure openings 13*e* due to a shock caused when the pullout unit U1 is pulled out. Therefore, the floor can be prevented from being stained.

Further, as a further exemplary embodiment, the wall portions 51*d* are provided on the four sides of each of the protection members 51 as a collecting portion capable of collecting the developer. In this manner, the developer (toner) accumulated on each of the protection members 51 stays inside the wall portions 51*d* provided on the four sides. As a result, the developer can be more reliably prevented from dropping on the floor and staining the floor due to a shock caused when the pullout unit U1 is operated.

Second Embodiment

Figure 12:
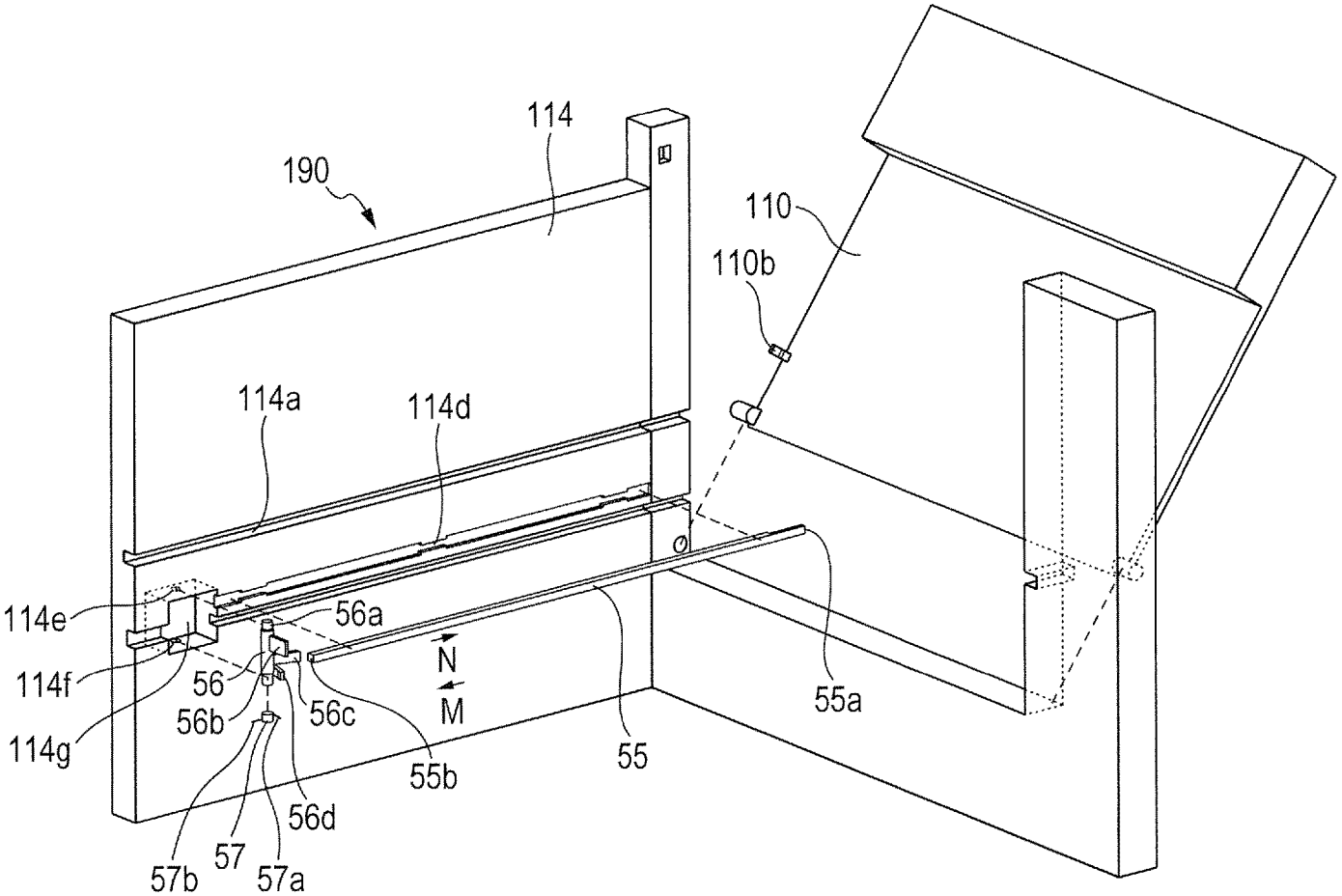
FIG. 12 is a perspective view for illustrating a configuration of a latching portion of the main body according to a second embodiment.

Next, a second embodiment of the present invention will be described referring to the drawings. In the embodiment, a configuration of the pullout unit U1 is the same as that of the first embodiment. Therefore, the same parts are denoted by the same reference symbols, and only different parts of the main body will be described in detail. In the first embodiment, the actuating member 54 is moved in the direction indicated by the arrow I by the latching portion 14*c* provided on the main body (FIGS. 3 and 11A). On the other hand, in the embodiment, the actuating member 54 is moved in the direction indicated by the arrow I by a latching portion 110*b* provided on a door 110 of a main body of an image forming apparatus 190, as illustrated in FIG. 12. FIG. 12 is a perspective view for illustrating a configuration of the latching portion 110*b* of the main body, and corresponds to a part of FIG. 10.

A slide link member 55, a rotating link member 56, and a torsion coil spring 57 are arranged in the main body. The slide link member 55 is slidably fitted into a guiding groove 114*d* formed in the main body. The guiding groove 114*d* is arranged in parallel to a guiding portion 114*a* along which the pullout unit U1 is moved. Further, a latched portion 55*a*, which is capable of abutting against the latching portion 110*b* being a convex portion provided on the door 110, is provided on one end of the slide link member 55 in a direction indicated by the arrows N and M, whereas an abutment portion 55*b*, which abuts against the rotating link member 56, is provided on another end of the slide link member 55.

The rotating link member 56 includes a shaft portion 56*a*, which is turnably fitted into holes 114*e* and 114*f* of the main body. The rotating link member 56 includes the shaft portion 56*a*, two abutment portions 56*b* and 56*c* radially projecting from the shaft portion 56*a*, and a fixing portion 56*d*. The abutment portion 56*b* of the rotating link member 56 is a portion that abuts against the abutment portion 55*b* of the slide link member 55. The abutment portion 56*c* is a portion that abuts against the latched portion 54*c* of the actuating member 54. The fixing portion 56*d* is a fixing portion for an arm portion 57*a* of the torsion coil spring 57.

The torsion coil spring 57 is fitted onto the shaft portion 56*a* provided on one end of the rotating link member 56. The arm portion 57*a* is latched to the fixing portion 56*d* of the rotating link member 56, whereas another arm portion 57*b* is latched to an inner wall 114*g* of the main body. The rotating link member 56 is biased in a direction indicated by the arrow V in FIG. 13B, which is a counterclockwise direction, by the torsion coil spring 57.

Figure 13A:
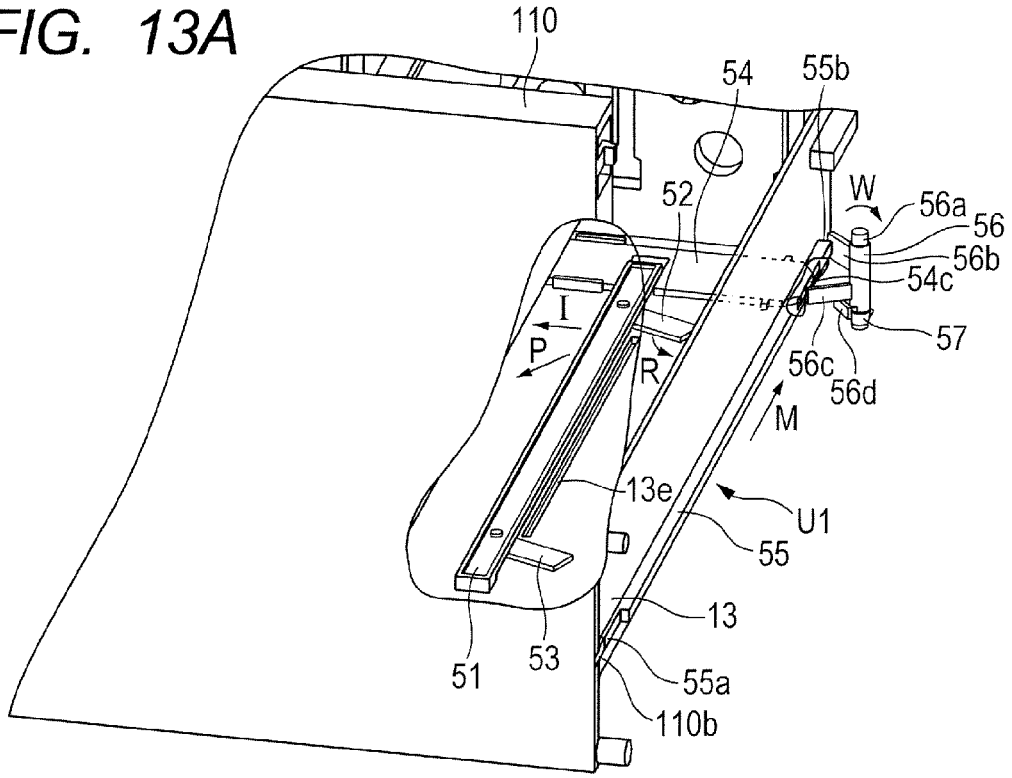
FIGS. 13A and 13B are perspective views for illustrating an operation of a protection member as a shielding member according to the second embodiment.
Figure 13B:
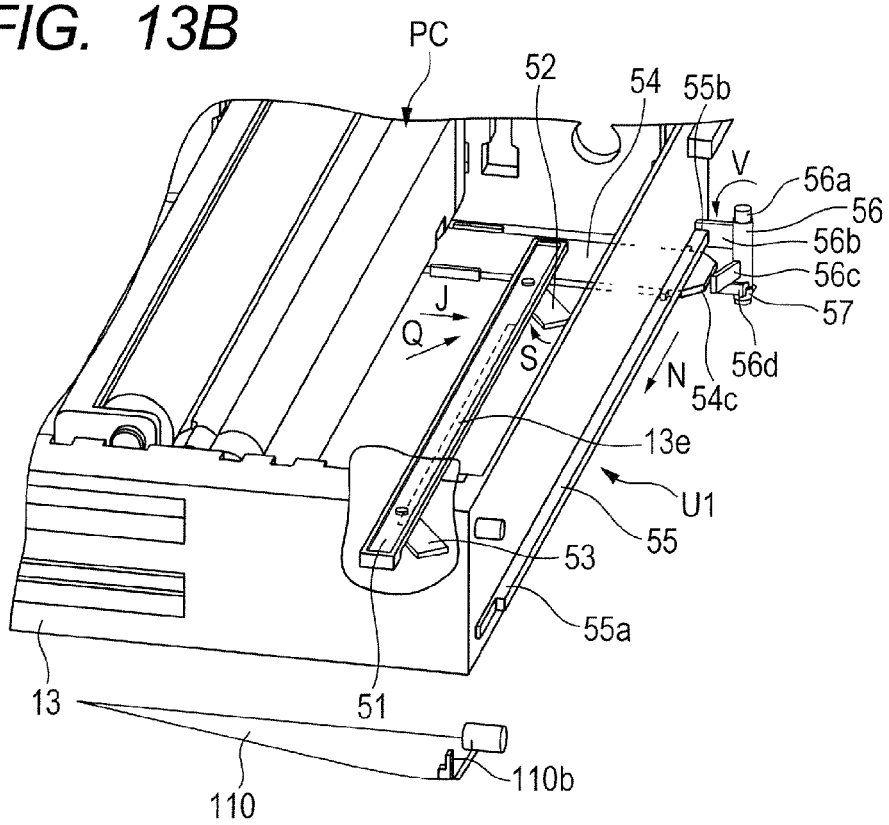

Next, referring to FIGS. 13A and 13B, an operation of the protection members as the shielding members capable of shielding the exposure openings will be described. FIG. 13A is a perspective view for illustrating the pullout unit U1 when the door 110 of the main body is closed, and FIG. 13B is a perspective view for illustrating a state in which the moving member 113 assumes the inner position of the main body and the door 110 is opened. FIGS. 13A and 13B respectively correspond to FIGS. 11A and 11B of the first embodiment.

As illustrated in FIG. 13A, by closing the door 110, the latching portion 110*b* of the door 110 abuts against the latched portion 55*a* of the slide link member 55 so that the slide link member 55 is guided by the guiding groove 114*d* of the main body to move in the direction indicated by the arrow M. Then, the abutment portion 55*b* of the slide link member 55 abuts against the abutment portion 56*b* of the rotating link member 56.

The rotating link member 56 rotates about the shaft portion 56*a* in a direction indicated by the arrow W in FIG. 13A, which is a clockwise direction. Then, the abutment portion 56*c* of the rotating link member 56 abuts against the latched portion 54*c* of the actuating member 54. As a result, the actuating member 54 is moved in the direction indicated by the arrow I. Through the movement of the actuating member 54 in the direction indicated by the arrow I, the protection members 51 as the shielding members covering the exposure openings 13*e* are displaced to the non-shielding position to open the exposure openings 13*e*, similarly to the above.

On the other hand, as illustrated in FIG. 13B, by opening the door 110, the latching portion 110*b* of the door 110 is moved away from the latched portion 55*a* of the slide link member 55. As a result, the actuating member 54 is moved by the compression spring 50 (see FIG. 6) in the direction indicated by the arrow J. As a result, the protection members 51 as the shielding members are displaced to the shielding position so that the exposure openings 13*e* are covered with the protection members 51. At this time, the rotating link member 56 rotates in a direction indicated by the arrow V in FIG. 13B, which is a counterclockwise direction, by a biasing force of the torsion coil spring 57. Then, the abutment portion 56*b* of the rotating link member 56 abuts against the abutment portion 55*b* of the slide link member 55 to move the slide link member 55 in a direction indicated by the arrow N.

With the configuration described above, the floor is prevented from being stained when the pullout unit U1 is pulled out. Besides, the toner can be prevented from dropping inside the main body from the cartridges P due to a shock caused when the pullout unit U1 is mounted. Thus, the dust-proof members 31 of the exposure device 3 can be prevented from being stained, thereby preventing a density from being lowered.

Third Embodiment

Next, a third embodiment of the present invention will be described referring to the drawings. In the embodiment, the link members 52 and 53 and the protection members 51 as the shielding members have the same configurations as those of the first embodiment, and such parts are denoted by the same reference symbols. Thus, only an actuating member 254 and a moving member 213 illustrated in FIGS. 15A and 15B, which are different from those of the main body of the first embodiment, will be described in detail.

In the first embodiment, the actuating member 54 is moved in the direction indicated by the arrow I by the latching portion 14*c* provided on the main body (FIGS. 3, 11A, and 11B). On the other hand, in the embodiment, the actuating member 254 illustrated in FIG. 15B is moved in the direction indicated by the arrow I by a cam 64 provided on the moving member 213. Then, the above-mentioned operation is performed in conjunction with a timing at which the drums 1 and the developing rollers 40 are moved into contact with and away from each other. A configuration of the cam 64 will be described referring to FIGS. 14A and 14B.

Figure 14A:
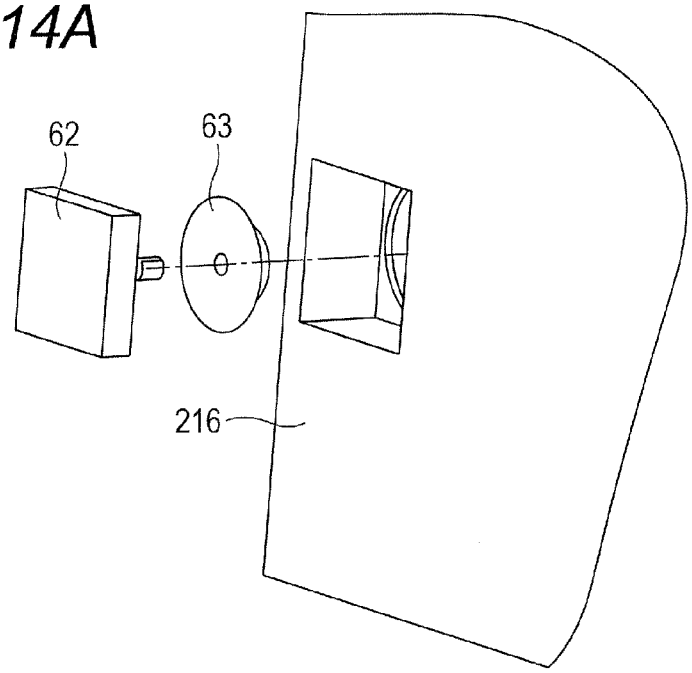
FIG. 14A is a perspective view for illustrating a configuration of a cam of a main body according to a third embodiment as viewed from a far side of the main body.
Figure 14B:
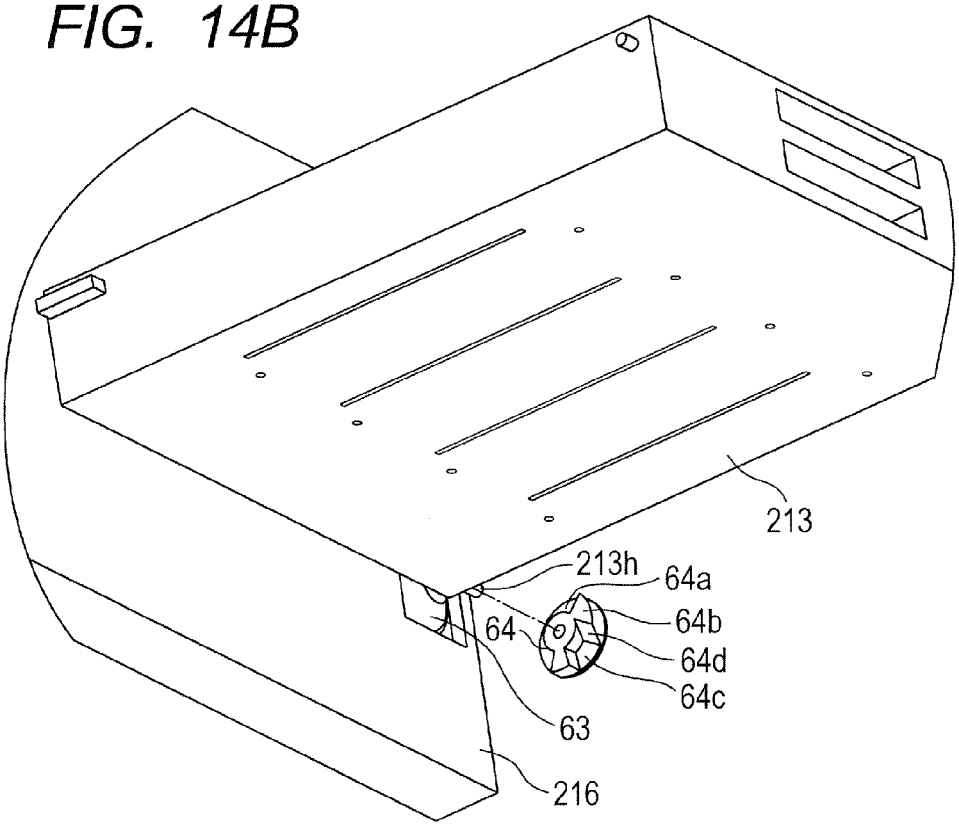
FIG. 14B is a perspective view for illustrating the configuration of the cam of the main body as viewed from a lower side of the main body.
Figure 15A:
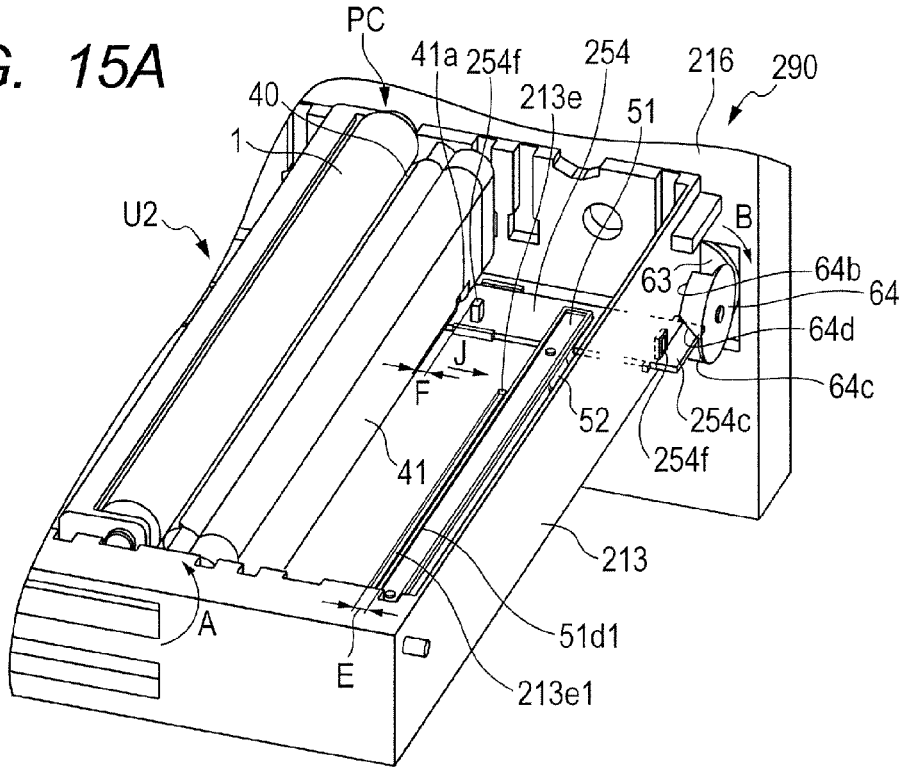
FIGS. 15A and 15B are perspective views for illustrating an operation of a protection member as a shielding member according to the third embodiment.
Figure 15B:
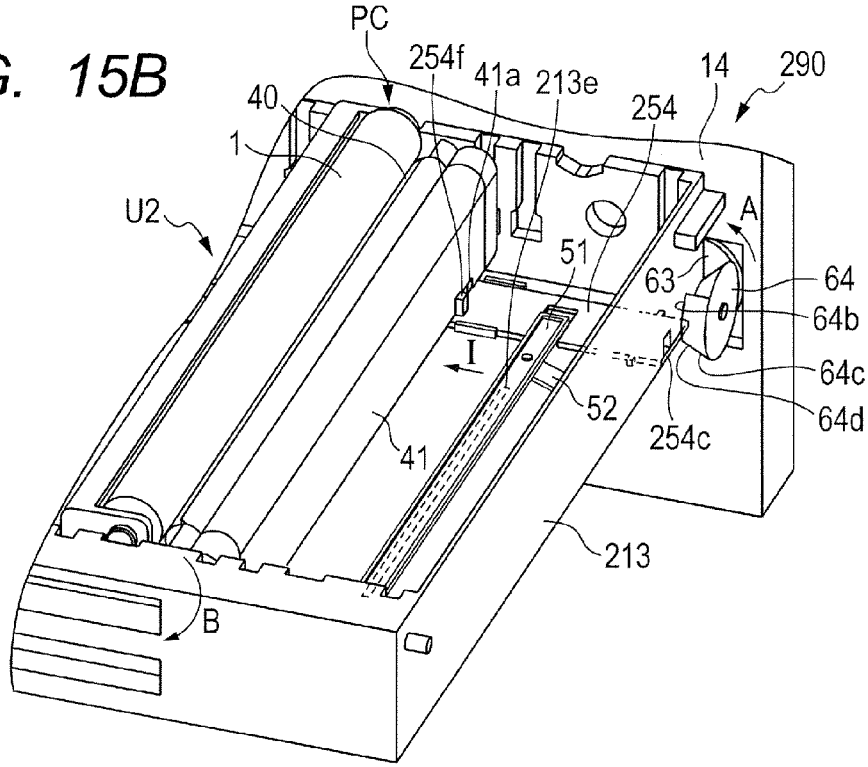

FIG. 14A is a perspective view for illustrating the configuration of the cam of a main body as viewed from a far side of the main body, and FIG. 14B is a perspective view for illustrating the configuration of the cam 64 of the main body as viewed from a lower side of the main body. FIGS. 15A and 15B correspond to a part of FIGS. 11A and 11B according to the first embodiment.

As illustrated in FIGS. 14A and 14B, members configured to actuate the actuating member 254 include a motor 62, a bevel gear 63, and the cam 64. The motor 62 is provided on a back frame 216 of the main body. The bevel gear 63 is fixed to a shaft of the motor 62. The cam 64 is turnably mounted to a shaft 213*h* provided on an outer surface of the moving member 213. The cam 64 includes a partly toothless bevel gear portion 64*a*, a convex portion 64*b*, a concave portion 64*c*, and a slope portion 64*d*. The partly toothless bevel gear portion 64*a* meshes with the bevel gear 63. The convex portion 64*b* presses a latched portion 254*c* of the actuating member 254, whereas the concave portion 64*c* is moved away from the latched portion 254*c*. The slope portion 64*d* smoothly connects the convex portion 64*b* and the concave portion 64*c* to each other.

Next, referring to FIG. 15A, a configuration of moving the photosensitive drum 1 and the developing roller into contact with and away from each other and a configuration of the actuating member 254 will be described. FIG. 15A is a perspective view for illustrating a pullout unit U2 inside a main body of an image forming apparatus 290 during the image formation, and corresponds to FIG. 11A of the first embodiment.

In FIG. 15A, the toner container 41 has a concave portion 41*a* formed at a position opposed to the biasing spring 9 (see FIG. 7). The actuating member 254 has a convex portion 254*f* formed so as to be opposed to the concave portion 41*a* of the toner container 41. Through movement of the actuating member 254 in directions indicated by the arrows I and J, the concave portion 41*a* and the convex portion 254*f* are moved into contact with and away from each other.

A distance E between an edge portion 51*d*1 of the protection member 51 located on the side of an exposure opening 213*e* and an edge portion 213*e*1 of the exposure opening 213*e* in the directions indicated by the arrows I and J for the actuating member 254 is smaller than a distance F between the concave portion 41*a* of the toner container 41 and the convex portion 254*f* of the actuating member 254. In this manner, a timing at which the protection member 51 opens and closes the exposure opening 213*e* and a timing at which the drum 1 and the developing roller 40 are moved into contact with and away from each other are controlled (details of the timings will be described later).

Next, referring to FIGS. 15A and 15B, the operation of opening and closing the exposure opening 213*e* by the protection member 51 as the shielding member and the operation of moving the photosensitive drum 1 and the developing roller 40 into contact with and away from each other will be described. FIG. 15B is a perspective view for illustrating the pullout unit U2 inside the main body when the exposure opening 213*e* is covered with thex protection member 51 (during non-image formation, excluding the time immediately before and after the image formation), and corresponds to FIG. 11B of the first embodiment.

As illustrated in FIG. 15A, when the motor 62 (FIG. 14A) rotates in a direction indicated by the arrow B in FIG. 15A, which is a clockwise direction, the cam 64 rotates. Then, due to the biasing force of the compression spring 50 (FIGS. 6 and 10), the latched portion 254*c* of the actuating member 254, which has been held in abutment against the convex portions 64*b* of the cam 64, now abuts against the slope portion 64*d*. As a result, the actuating member 254 is moved in the direction indicated by the arrow J.

As a result, the convex portion 254*f* of the actuating member 254 is first moved away from the concave portion 41*a* of the toner container 41 to bring the developing roller 40 and the photosensitive drum 1 into abutment against each other. Thereafter, the protection member 51, which covers the exposure opening 213*e* as described above, is displaced to the non-shielding position. On the other hand, as illustrated in FIG. 15B, when the motor 62 (FIG. 14A) rotates in a direction indicated by the arrow A in FIG. 15B, which is a counterclockwise direction, the cam 64 rotates. Then, the latched portion 254*c* of the actuating member 254 is pressed by the slope portion 64*d* of the cam 64 in the direction indicated by the arrow I. As a result, as described above, the exposure opening 213*e* is first covered with the protection member 51 as the shielding member (the protection member 51 is held in the shielding position).

Thereafter, the convex portion 254*f* of the actuating member 254 presses the concave portion 41*a* of the toner container 41. As a result, the developing unit 4 turns about the engaging portion 70*a* (see FIG. 9) as a center of rocking in a direction indicated by the arrow B in FIG. 15B, which is a counterclockwise direction, to move the photosensitive drum 1 and the developing roller 40 away from each other.

With the configuration described above, not only the developer (toner) can be prevented from dropping due to the mounting and removal of the pullout unit U2 into and from the main body but also the following can be prevented. Specifically, the toner can be prevented from dropping inside the main body from the cartridge P due to a shock caused when the photosensitive drum 1 and the developing roller 40 are moved into contact with and away from each other. In this manner, the dust-proof members 31 of the exposure device 3 can be prevented from being stained, thereby preventing the density from being lowered.

Fourth Embodiment

Next, a fourth embodiment of the present invention will be described referring to the drawings. In the embodiment, the link members 52 and 53 and the protection members 51 as the shielding members have the same configurations as those of the above-mentioned embodiments, and such parts are denoted by the same reference symbols. Thus, only an actuating member 354 and a moving member 313 as different parts of the main body of the above-mentioned embodiments will be described in detail.

In the first embodiment, a direction in which the pullout unit U1 is mounted on and removed from the main body is the axial direction of the photosensitive drums 1 (FIGS. 2, 11A, and 11B). On the other hand, in the embodiment, a direction in which a pullout unit U3 is mounted on and removed from a main body of an image forming apparatus 390 is a direction in which the four color cartridges P are aligned, which is a direction orthogonal to the axial direction of the photosensitive drums 1. A configuration of the pullout unit U3 will be described referring to FIG. 16.

Figure 16:
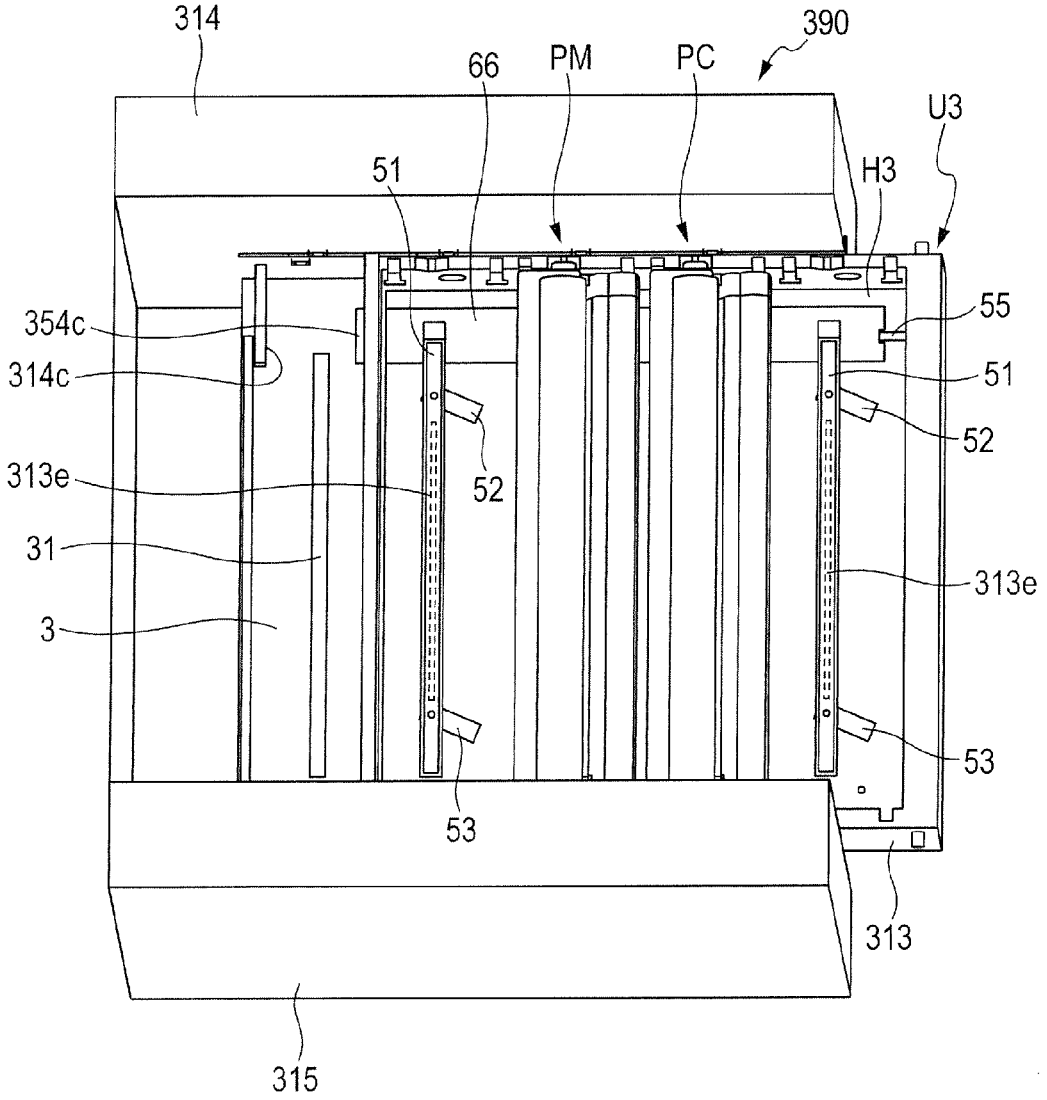
FIG. 16 is a perspective view of a main body of an image forming apparatus according to a fourth embodiment when a pullout unit starts being pulled out as viewed from above.

FIG. 16 is a perspective view of the main body of the image forming apparatus 390 when the pullout unit U3 starts being pulled out as viewed from above, and corresponds to FIG. 11B of the first embodiment. For easy understanding, the cartridges PK and PY, the intermediate transfer belt 5 (FIG. 1), and the delivery tray 24 (FIG. 1) are omitted.

As illustrated in FIG. 16, in the pullout unit U3, guided portions of the moving member 313 provided on the moving member 313 are guided by a pair of guiding portions respectively provided on an inner wall surface of a side frame 314 and an inner wall surface of a side frame 315 of the main body. Then, the pullout unit U3 is moved in the direction orthogonal to the axial direction of the photosensitive drums 1 (direction in which the four cartridges PY, PM, PC, and PK are aligned).

A latching portion 314*c* is provided on the side frame 314 of the main body, whereas a latched portion 354*c* is provided on the actuating member 313 so as to be opposed to the latching portion 314*c*. Through the movement of the pullout unit U3, the latching portion 314*c* and the latched portion 354*c* are moved into contact with and away from each other.

When the pullout unit U3 is mounted on the main body (at the time of the image formation), the actuating member 354 is moved by the latching portion 314*c* as in the first embodiment. As a result, the protection members 51, which cover exposure openings 313*e*, are displaced to the non-shielding positions to open the exposure openings 313*e* (not shown). On the other hand, when the pullout unit U3 starts being pulled out, the actuating member 354 is moved by the biasing force of the compression spring 50 so that the exposure openings 313*e* are covered with the protection members 51 displaced to the shielding positions as in the first embodiment. Even with the configuration described above, the toner can be prevented from dropping on the floor from the cartridges P to prevent the floor from being stained due to a shock caused when the pullout unit U3 is pulled out.

Fifth Embodiment

Next, a fifth embodiment of the present invention will be described referring to the drawings. In the embodiment, a main body has the same configuration as that of each of the embodiments described above, and the same parts are denoted by the same reference symbols. Thus, only different parts of a pullout unit U4 will be described in detail.

Figure 17:
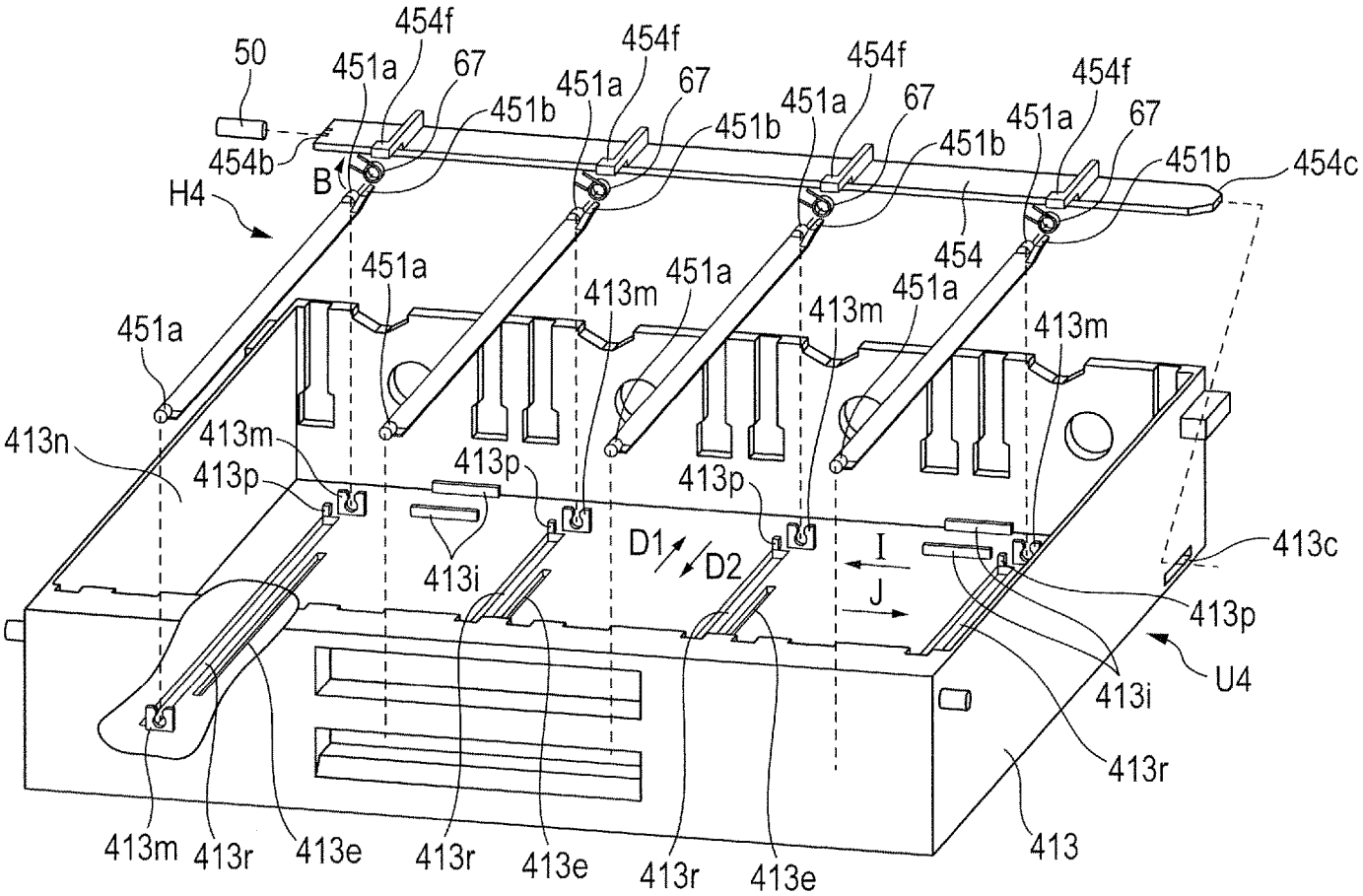
FIG. 17 is a perspective view for illustrating a configuration of a pullout unit according to a fifth embodiment.

In the first embodiment, the protection member 51 as the shielding member and the link members 52 and 53 form the four-bar parallel linkage. Through the slide of the four-bar parallel linkage, the exposure openings 13*e* are opened and closed (FIGS. 11A and 11B). On the other hand, as illustrated in FIG. 17 that is an illustration of the configuration of the pullout unit U4, each of protection members 451 as the shielding members rotates about shafts 451*a* provided on both ends to open and close each exposure opening 413*e* in the embodiment. FIG. 17 is a perspective view for illustrating the pullout unit U4 of the main body, and corresponds to FIG. 10.

As illustrated in FIG. 17, a protection member unit H4 includes the protection members 451 as the shielding members, the torsion coil springs 67, an actuating member 454, and the compression spring 50. Each of the protection members 451 has a size large enough to cover the corresponding exposure opening 413*e*. Further, each of the protection members 451 includes the shafts 451*a* on both ends in directions indicated by the arrows D1 and D2. Each of the protection members 451 is turnably supported by bearing portions 413*m* provided on both ends of the corresponding exposure opening 413*e* of a moving member 413. Further, a convex portion 451*b*, which extends upward in the vertical direction, is provided on one end of each of the protection members 451.

Each of the torsion coil springs 67 is mounted to the shaft 451*a* (FIG. 17) provided on one end of the corresponding protection member 451. One arm portion of each of the torsion coil springs 67 is held in abutment against the convex portion 451*b* of the protection member 451, whereas another arm portion is held in abutment against a convex portion 413*p* (FIG. 17) provided on the moving member 413. In this manner, the protection members 451 are biased in a direction indicated by the arrow B in FIG. 18B, which is a clockwise direction.

Figure 18A:
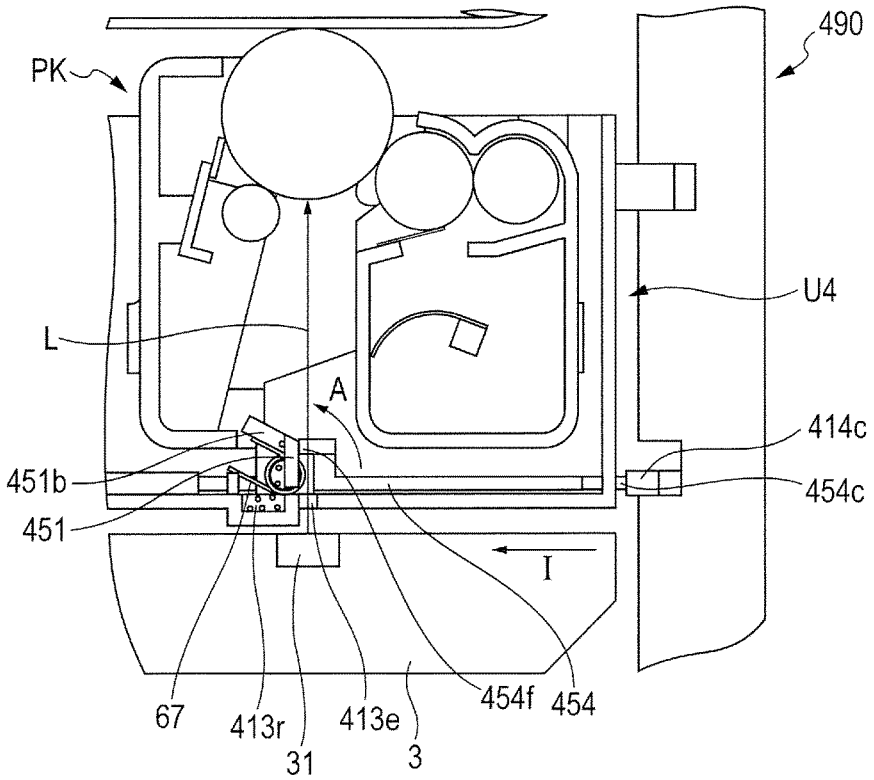
FIG. 18A is a sectional view for illustrating a state during image formation in which a moving member according to the fifth embodiment assumes an inner position of the main body.
Figure 18B:
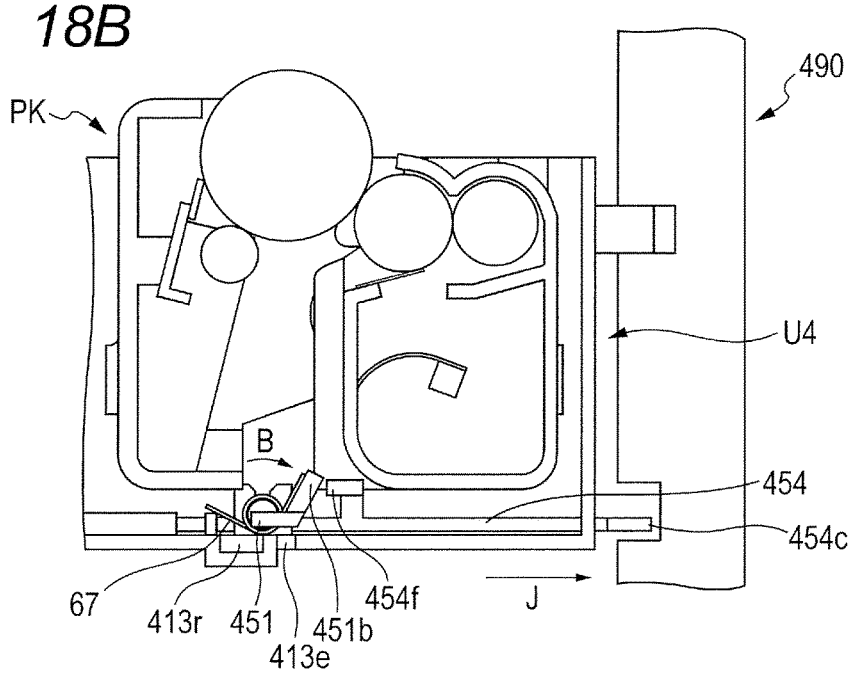
FIG. 18B is a sectional view for illustrating a state in which a door of the main body is opened and the moving member starts being pulled toward the near side.

In FIGS. 18A and 18B, both ends of the actuating member 454 in the directions indicated by the arrows D1 and D2 (FIG. 17) are guided by guiding portions 413*i* (FIG. 17) provided on the moving member 413. In this manner, the actuating member 454 is mounted on the moving member 413 so as to be slidable in directions indicated by the arrows I and J. Further, convex portions 454*f* are provided on the actuating member 454 at four positions in a longitudinal direction so as to be opposed to the convex portions 451*b* of the protection members 451. Through the movement of the actuating member 454, the convex portions 451*b* and the convex portions 454*f* are moved into contact with and away from each other. The moving member 413 includes concave portions 413*r* longer than the exposure openings 413*e* on a side of the exposure openings 413*e*, which is closer to the bearings in the direction of alignment of the cartridges P.

Next, referring to FIGS. 18A and 18B, an operation of the protection members 451 will be described. FIG. 18A is a sectional view for illustrating a state during the image formation in which the moving member 413 assumes the inner position of a main body of an image forming apparatus 490, and corresponds to FIG. 11A. FIG. 18B is a sectional view for illustrating a state in which a door (not shown) of the main body is opened and the moving member 413 starts being pulled toward the near side, and corresponds to FIG. 11B.

As illustrated in FIG. 18A, during the image formation, the actuating member 454 is moved in a direction indicated by the arrow I by a latching portion (a protruding portion) 414*c* of the main body. As a result, the convex portions 454*f* of the actuating member 454 press the convex portions 451*b* of the protection members 451 to rotate the protection members 451 in a direction indicated by the arrow A in FIG. 18A, which is a counterclockwise direction. As a result, the protection members 451 as the shielding members which cover the exposure openings 413*e* are displaced to the non-shielding positions to open the exposure openings 413*e*. In this manner, the laser beams L can pass through the exposure openings 413*e*.

When the pullout unit U4 is pulled out of the main body as illustrated in FIG. 18B, the actuating member 454 is moved by the compression spring 50 in the direction indicated by the arrow J. As a result, the convex portions 454*f* of the actuating member 454 and the convex portions 451*b* of the protection members 451 are moved away from each other. Then, the protection members 451 rotate in a direction indicated by the arrow B in FIG. 18B, which is a clockwise direction, by the torsion coil springs 67. As a result, the exposure openings 413*e* are covered with the protection members 451 located in the shielding positions.

According to the configuration described above, the toner can be prevented from dropping on the floor from the cartridges P due to a shock caused when the pullout unit U4 is pulled out, thereby being configured to prevent the floor from being stained, as in the first embodiment. The developer (toner) accumulated on (surfaces of) the protection members 451 slips down due to the gravity through the rotation of the protection members 451. As described above, the concave portions 413*r* of the moving member 413 function as collecting portions configured to collect the developer accumulated on the surfaces of the protection members 451 as the shielding members. As a result, the inside of the main body can be prevented from being stained with the toner due to a shock caused when the protection members 451 close the exposure openings 413*e*.

Finally, the effects of each of the embodiments described above are summarized as follows. According to the configuration of each of the embodiments described above, the developer can be prevented from being scattered inside the main body when the moving member is moved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-121243, filed Jun. 12, 2014, which is hereby incorporated by reference herein in its entirety.

What is claimed is:

1. An image forming apparatus, comprising:

a main body;

a moving member movable with respect to the main body in a state of supporting an image forming portion comprising an image bearing member, the moving member movable between an inside position located inside of the main body and an outside position located outside of the main body, and in which at least a part of the image forming portion is removably mountable on the moving member as a cartridge;

an exposure device configured to perform light exposure for forming an electrostatic latent image on the image bearing member through an exposure opening provided in the moving member;

a shielding member provided on the moving member and configured to shield the exposure opening; and a holding mechanism configured to hold the shielding member in a shielding position corresponding to the exposure opening while the moving member is moved between the inside position and the outside position, and to hold the shielding member in a non-shielding position in which the exposure opening is opened when the moving member is located in the inside position.

2. An image forming apparatus according to claim 1, further comprising a light transmitting member configured to be in close contact with the exposure opening.

3. An image forming apparatus according to claim 1, wherein the holding mechanism is arranged in the moving member.

4. An image forming apparatus according to claim 1, wherein the exposure device is provided in the main body.

5. An image forming apparatus according to claim 1, wherein the holding mechanism is configured to hold the shielding member in the shielding position in conjunction with drive of the main body when the moving member is moved between the inside position and the outside position.

6. An image forming apparatus according to claim 1, wherein the image forming portion further comprises a developer carrying member configured to develop the electrostatic latent image formed on the image bearing member, wherein the image bearing member and the developer carrying member are moved into contact with and away from each other in conjunction with an operation of the holding mechanism, and wherein the image bearing member and the developer carrying member are moved away from each other when the shielding member is held in the shielding position.

7. An image forming apparatus according to claim 1, wherein the holding mechanism comprises:

an actuating member configured to hold the shielding member;

a biasing member configured to bias the actuating member against a predetermined latching portion when the moving member is located in the inside position; and a link member configured to displace the shielding member from the non-shielding position to the shielding position when the actuating member is unlatched from the latching portion during movement of the moving member from the inside position to the outside position.

8. An image forming apparatus according to claim 1, further comprising a collecting portion configured to collect a developer accumulated on a surface of the shielding member.

9. An image forming apparatus according to claim 1, wherein the image forming portion comprises a developer carrying member configured to develop the electrostatic latent image formed on the image bearing member.

10. An image forming apparatus according to claim 1, wherein the image forming portion comprises:

an image bearing unit comprising the image bearing member; and a developing unit comprising a developer carrying member, and wherein only the developing unit among the image bearing unit and the developing unit is removably mountable on the moving member as the cartridge.

11. An image forming apparatus according to claim 1, wherein the cartridge comprises the image bearing member.

12. An image forming apparatus according to claim 1, wherein the moving member is configured to support a plurality of image forming portions, and a plurality of cartridges are removably mountable on the moving member when the moving member is located in the outside position.

13. An image forming apparatus according to claim 1, wherein the image bearing member is disposed above the exposure device when the moving member is located in the inside position.

14. An image forming apparatus according to claim 3, wherein the holding mechanism forms a mechanism configured to rotate the shielding member about an axis extending in a direction connecting both ends of the shielding member.

15. An image forming apparatus according to claim 5, wherein the drive of the main body comprises opening and closing a door configured to open and close an opening portion provided in the main body, the moving member being moved between the inside position and the outside position through the opening portion.

16. An image forming apparatus according to claim 7, wherein the holding mechanism forms a four-bar parallel linkage provided in the moving member.

17. An image forming apparatus according to claim 7, wherein the predetermined latching portion is provided in the main body or the moving member.

18. An image forming apparatus according to claim 9, wherein the cartridge comprises the developer carrying member.

* * * * *